US007587149B2

(12) United States Patent
Suzuki et al.

(10) Patent No.: US 7,587,149 B2
(45) Date of Patent: Sep. 8, 2009

(54) IMAGE FORMING APPARATUS AND METHOD FOR CONTROLLING THE SAME

(75) Inventors: Takehiko Suzuki, Suntou-gun (JP); Ken Nakagawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 407 days.

(21) Appl. No.: 11/567,426

(22) Filed: Dec. 6, 2006

(65) Prior Publication Data

US 2007/0134012 A1 Jun. 14, 2007

(30) Foreign Application Priority Data

Dec. 13, 2005 (JP) ..... 2005-359534
Dec. 28, 2005 (JP) ..... 2005-380170

(51) Int. Cl.
*G03G 15/00* (2006.01)

(52) U.S. Cl. ..... 399/49; 399/72; 399/82

(58) Field of Classification Search ..... 399/28, 399/39, 49, 72, 82
See application file for complete search history.

(56) References Cited

U.S. PATENT DOCUMENTS 6,091,913 A 7/2000 Suzuki et al.
6,463,227 B1 * 10/2002 Denton et al. ..... 399/49
7,035,562 B1 4/2006 Suzuki et al.
7,221,882 B2 5/2007 Nakagawa
2007/0134012 A1 6/2007 Suzuki et al.

FOREIGN PATENT DOCUMENTS

JP 11-65237 3/1999
JP 2001-343867 12/2001
JP 2002-82500 3/2002

* cited by examiner

*Primary Examiner*—Hoang Ngo
(74) *Attorney, Agent, or Firm*—Fitzpatrick, Cella, Harper & Scinto

(57) ABSTRACT

An image forming apparatus comprises an image forming part and a density calibration control part. The image forming part forms an image in any one of a plurality of image forming modes with respectively different processing speeds. The density calibration control part performs image density control for the image forming part in a state where any one of the plurality of image forming modes is applied. Herein, the density calibration control part makes a performing time interval for the image density control in a first image forming mode and a performing time interval for the image density control in a second image forming mode different from each other.

3 Claims, 24 Drawing Sheets

FIG. 12

| NUMBER OF PAGES ON WHICH IMAGES ARE FORMED | 50 | 100 | 150 | 200 | 250 | 300 |
|---|---|---|---|---|---|---|
| FLUCTUATION IN TONE CHARACTERISTICS IN NORMAL SPEED MODE | G | G | P | I | I | I |

FIG. 13

| NUMBER OF PAGES ON WHICH IMAGES ARE FORMED | 50 | 100 | 150 | 200 | 250 | 300 |
|---|---|---|---|---|---|---|
| FLUCTUATION IN TONE CHARACTERISTICS IN LOWER SPEED MODE | G | G | G | G | G | I |

IMAGE FORMING APPARATUS AND METHOD FOR CONTROLLING THE SAME

BACKGROUND OF THE INVENTION

1. Field of the Invention

The present invention relates to an image forming apparatus and a method for controlling the same.

2. Description of the Related Art

Generally, in image forming apparatuses using an electrophotographic image forming process, the image density tends to fluctuate depending on various conditions, such as the usage environment and the number of pages printed. In particular, in color image forming apparatuses that perform color printing by superimposing toner images with a plurality of colors, fluctuations in the image density of various colors also causes fluctuations in the color balance (so-called tint).

Thus, in recent years, Japanese Patent Application Laid-open No. 11-65237 proposed a color image forming apparatuses in which the amount of toner of a test image that is formed on an image carrier or the like is detected, and the image density is controlled based on the detection results.

Image forming apparatuses have a plurality of image forming modes with respectively different processing speeds. Examples of these image forming modes include a normal speed mode for performing standard printing, and a lower speed mode. The lower speed mode is used when performing printing on an OHT (overhead transparency) sheet or on cardboard, at a speed lower than that of the normal speed mode.

Generally, when the image forming mode is changed, the image density characteristics also change. Accordingly, in order to obtain a good color balance in all image forming modes, it is necessary to perform image density control for all image forming modes.

However, if the image density control is performed for all of many image forming modes, then the time that is necessary for the image density control becomes very long. More specifically, the time during which an image cannot be formed (downtime) is increased, and thus it is not preferable. Moreover, consumables, such as toner, will be used up more than necessary.

SUMMARY OF THE INVENTION

An image forming apparatus according to the present invention comprises an image forming part and a density calibration control part. The image forming part forms an image in any one of a plurality of image forming modes with respectively different processing speeds. The density calibration control part performs image density control for the image forming part in a state where any one of the plurality of image forming modes is applied. Herein, the density calibration control part makes a performing time interval for the image density control in a first image forming mode and a performing time interval for the image density control in a second image forming mode different from each other.

According to the present invention, the performing time interval for the image density control in the first image forming mode is different from the performing time interval for the image density control in the second image forming mode. In other words, the image density control is not performed each time in all image forming modes, and thus the downtime is shortened. Furthermore, the total amount of toner consumed in the image density control is reduced.

Further features of the present invention will become apparent from the following description of exemplary embodiments with reference to the attached drawings.

BRIEF DESCRIPTION OF THE DRAWINGS

FIG. 12 is a diagram showing the relationship between the number of pages on which images are formed and fluctuation in the tone characteristics in a normal speed mode.

FIG. 13 is a diagram showing the relationship between the number of pages on which images are formed and fluctuation in the tone characteristics in a lower speed mode.

DETAILED DESCRIPTION OF THE EMBODIMENTS

Hereinafter, embodiments according to the present invention are described. It will be appreciated that each embodiment described below is useful for understanding various concepts, such as superordinate concepts, intermediate concepts, and subordinate concepts of the present invention. Furthermore, the scope of the present invention is not limited to the embodiments, but determined by the claims.

First Embodiment

Figure 1:
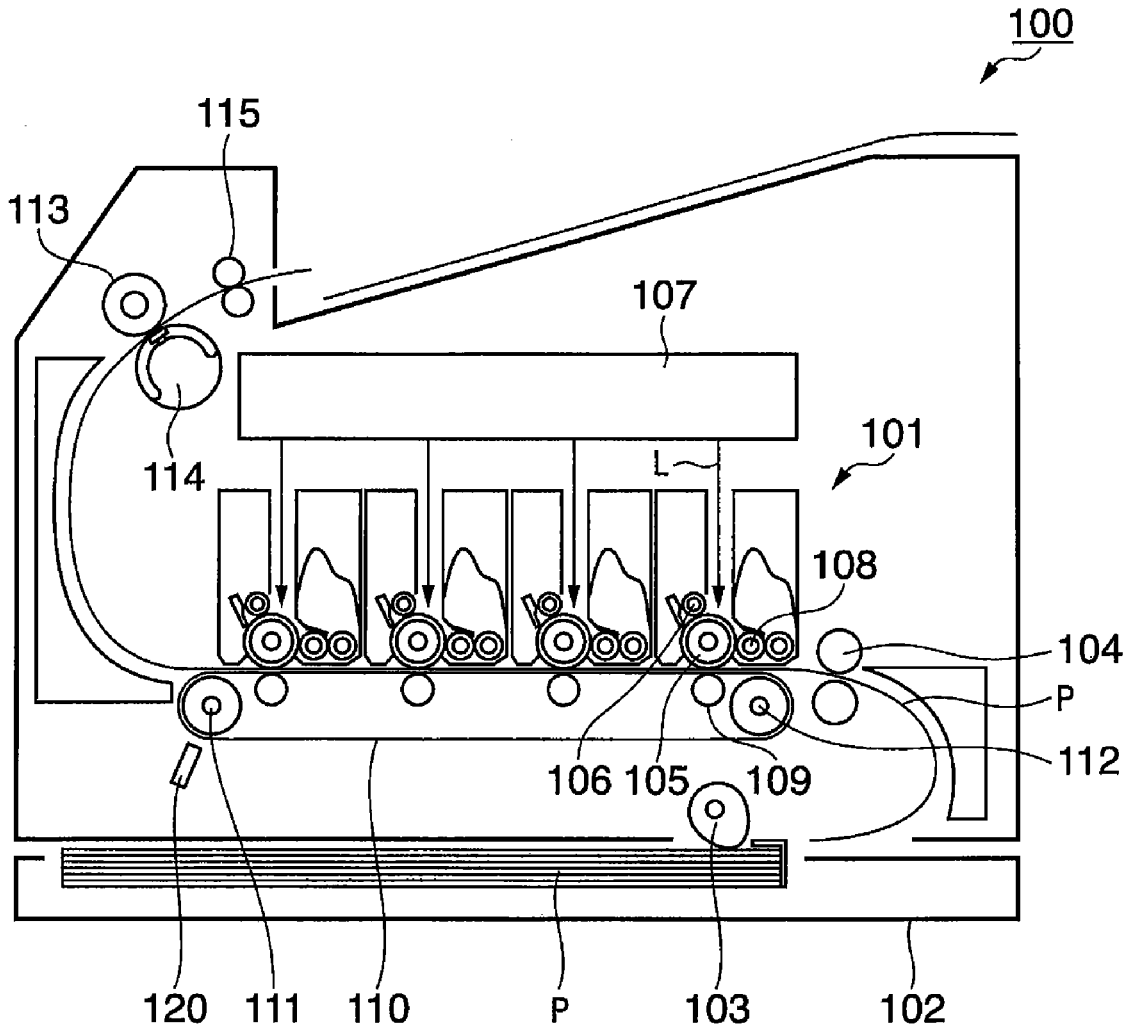
FIG. 1 is a schematic cross-sectional view of an image forming apparatus according to an embodiment.

FIG. 1 is a schematic cross-sectional view of an image forming apparatus according to an embodiment. In a multicolor image forming apparatus 100, an electrophotographic method is adopted in an image forming part 101. It should be noted that image forming apparatuses are realized as a printing apparatus, a printer, a copier, a multi-functional machine, or a facsimile, for example.

A plurality of recording materials P are held in a recording material cassette 102. A paper feed roller 103 feeds the recording materials P by picking them up one by one from the recording material cassette 102. The recording material also may be referred to as a recording medium, paper, a sheet, a transfer material, or transfer paper. The fed recording material P is transported up to a registration roller pair 104. Then, the recording material P is carried by the registration roller pair 104 to the image forming part 101 at a predetermined timing.

Herein, the image forming part 101 is constituted by four image forming stations that form images using developers of respectively different colors on the recording material P. In this example, yellow, magenta, cyan, and black toners are used as the developers.

Figure 2:
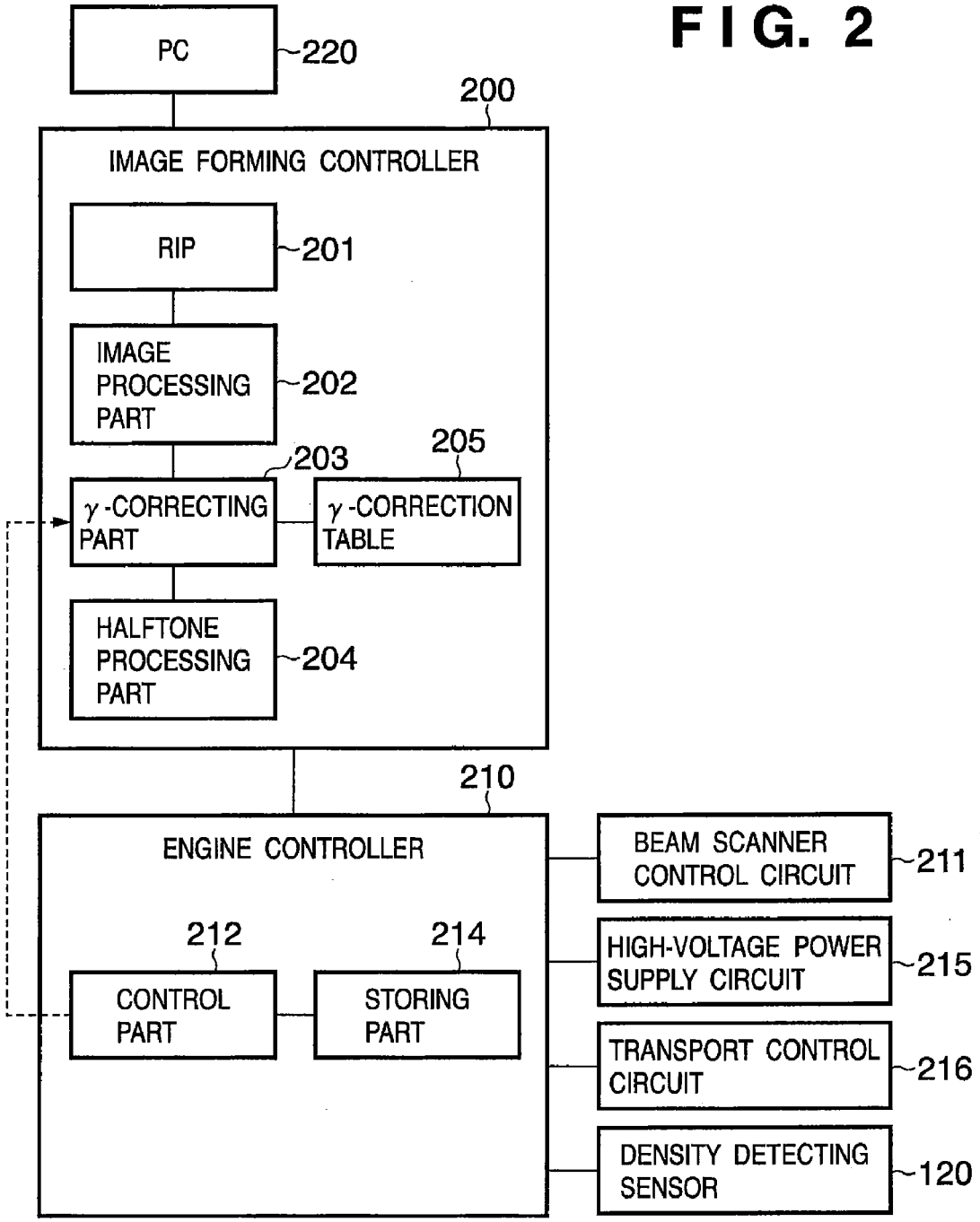
FIG. 2 is a block diagram showing one example of a control part according to the embodiment.

A photosensitive drum 105 is one type of an image carrier, and its surface is uniformly charged by a charge roller 106 to which electric power is supplied from a high-voltage power supply circuit (FIG. 2). The surface of the photosensitive drum 105 is irradiated with a light beam L by a beam scanner unit 107. Accordingly, an electrostatic latent image is formed on the surface of the photosensitive drum 105. In this manner, the beam scanner unit 107 has the function of forming an electrostatic latent image.

Development rollers 108 develop the electrostatic latent image using a developer, such as toner, thereby forming a toner image. The toner image on the photosensitive drum 105 is transferred by a transfer roller 109 to the recording material P.

An electrostatic transfer belt also referred to as an electrostatic adsorptive transfer belt (hereinafter, referred to as an ETB) 110 is positioned between the photosensitive drum 105 and the transfer roller 109. The ETB 110 is stretched between a drive roller 111 and a tension roller 112. The ETB 110 is rotated by the drive roller 111. The recording material P is transported to each image forming station while being attracted to the ETB 110. It should be noted that the ETB 110 functions as an image carrier during density adjustment and tone adjustment.

The recording material P onto which toner images with respective colors have been transferred one after another at the image forming stations is transported to a fixing nip part. The fixing nip part is constituted by a pressure roller 113 and a heating unit 114. Unfixed toner images are fixed on the recording material P by being heated and pressed at the fixing nip part. Then, the recording material P is discharged by paper discharge rollers 115 to the outside of the image forming apparatus 100.

A density detecting sensor 120 detects the density of test images formed on the ETB 110. The ETB 110 also functions as an image carrier for carrying test images during density adjustment and tone adjustment. The test images also may be called a test patch, a patch pattern, a pattern image, or a patch image.

The image forming apparatus 100 is provided with a plurality of image forming modes with respectively different processing speeds. Examples of these image forming modes include a normal speed mode and a lower speed mode. The processing speed in the normal speed mode is higher than the processing speed in the lower speed mode.

The processing speed in the normal speed mode is usually determined using, as a reference, plain paper, such as PPC (plain paper copier) paper, which is most frequently used. On the other hand, the processing speed in the lower speed mode is determined using, as a reference, an OHT sheet or cardboard, for example. The reason for this is that the fixing speed for an OHT sheet is preferably low in order to improve the transmission of toner.

Furthermore, the heat capacity of cardboard is larger than that of plain paper, and thus the cardboard requires a larger amount of heat energy than that for plain paper in order to fix toner. Thus, it is preferable to increase the amount of heat energy applied per unit time by lowering the fixing speed for cardboard.

Due to this reason, the processing speed in the lower speed mode usually is approximately ½ to ¼ of the processing speed in the normal speed mode. In an experiment below-described, the processing speed in the normal speed mode is 100 mm/sec, and the processing speed in the lower speed mode is 50 mm/sec.

Herein, in image forming apparatuses using the electrophotographic method, the density characteristics and the tone characteristics fluctuate depending on environmental conditions, such as the temperature and the humidity at which the apparatuses are used, and the degree at which the image forming stations have worn out. In order to correct this fluctuation, image density control as density calibration control is necessary.

In the image forming apparatus 100, test images with respective colors are formed on the ETB 110, and read by the density detecting sensor 120. Based on the acquired density data, the image forming apparatus 100 adjusts parameters (example: processing conditions and a γ-correction table) regarding the charge bias corresponding to the density, the amount of a scanning light beam corresponding to the tone, and the like. Accordingly, the maximum density characteristics and the tone characteristics of each color become suitable.

FIG. 2 is a block diagram showing one example of a control part according to this embodiment. An image forming controller 200 is a control part for processing a job that has been received from a PC 220. An engine controller 210 is a control part for controlling components, such as the image forming part 101. All of the controllers may be constituted by a CPU, a RAM, a ROM, an ASIC, or the like.

A raster image processor (RIP) 201 expands page description language data that has been received from the PC 220 into RGB bitmap data. An image processing part 202 performs a color matching process and a color separation process on the bitmap image. A g correcting part 203 performs g correction on CMYK data that has been output from the image processing part. It is generally known that the g characteristics of the image forming part 101 change depending on factors, such as the environment in which the image forming apparatus 100 is used and the number of pages printed. Accordingly, the g correction can provide a desired tone. Herein, the g correcting part 203 performs the g correction using a g correction table 205.

A halftone processing part 204 performs a halftone process, such as a halftone dot process, on the image data after the g correction. An image signal that has been output from the halftone processing part 204 is input to a beam scanner control circuit 211 inside the engine controller 210. Based on the input image signal, the beam scanner control circuit 211 controls the amount of a scanning light beam that is output from the beam scanner unit 107. In this manner, the beam scanner unit 107 forms an electrostatic latent image on the surface of the photosensitive drum 105.

A control part 212 performs overall control of each part of the engine controller 210 and each unit connected to the engine controller 210. According to this embodiment, the control part 212 makes performing time intervals in the plurality of image density control modes different from each other. Herein, the control part 212 applies different image density control modes respectively for the normal speed mode and for the lower speed mode.

A storing part 214 refers to a ROM or a RAM for storing control programs and various types of data. A high-voltage power supply circuit 215 applies a high voltage (several hundred volts) to the charge roller 106 and the development rollers 108 based on processing conditions (charge conditions and development conditions) that have been determined in the image density control.

A transport control circuit 216 drives the photosensitive drum 105 and the drive roller 111 based on the processing speeds that have been specified by the control part 212.

Figure 3:
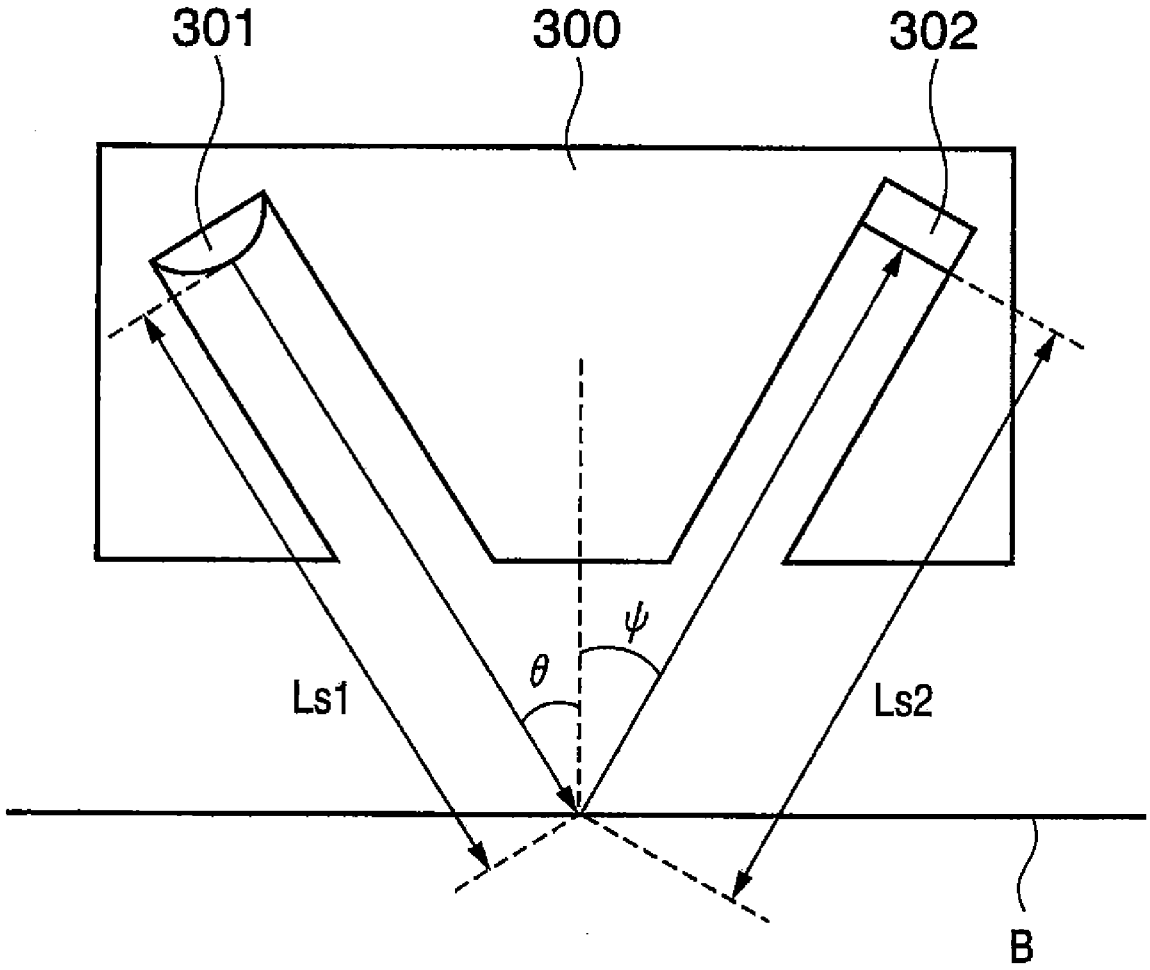
FIG. 3 is a view illustrating one example of a density detecting sensor according to the embodiment.

FIG. 3 is a view illustrating one example of a density detecting sensor according to this embodiment. Herein, an optical sensor is used as one example of the density detecting sensor 120. A light-emitting element 301, such as an LED and a light-receiving element 302, such as a photodiode are attached to a housing 300. Light irradiated from the light-emitting element 301 is incident on a measurement target B at an angle of θ, and reflected by the measurement target B. The light-receiving element 302 is opposed to the measurement target B at an angle of ψ, and detects both direct reflection light and diffuse reflection light from the measurement target B. Generally, θ and ψ are equal to each other, and 30° for example.

The detection principle of test images of this optical sensor is described next. Light that has been emitted from the light-emitting element 301 is reflected by the ETB 110 serving as a base, and detected by the light-receiving element 302. When a test image is formed on the ETB 110, the part of the base corresponding to toner is hidden, and thus the amount of reflection light is reduced. Accordingly, as the amount of toner of the test image is increased, the amount of reflection light is gradually reduced. It is possible to obtain the density of the test image based on this relationship between the toner density and the amount of reflection light.

Figure 4:
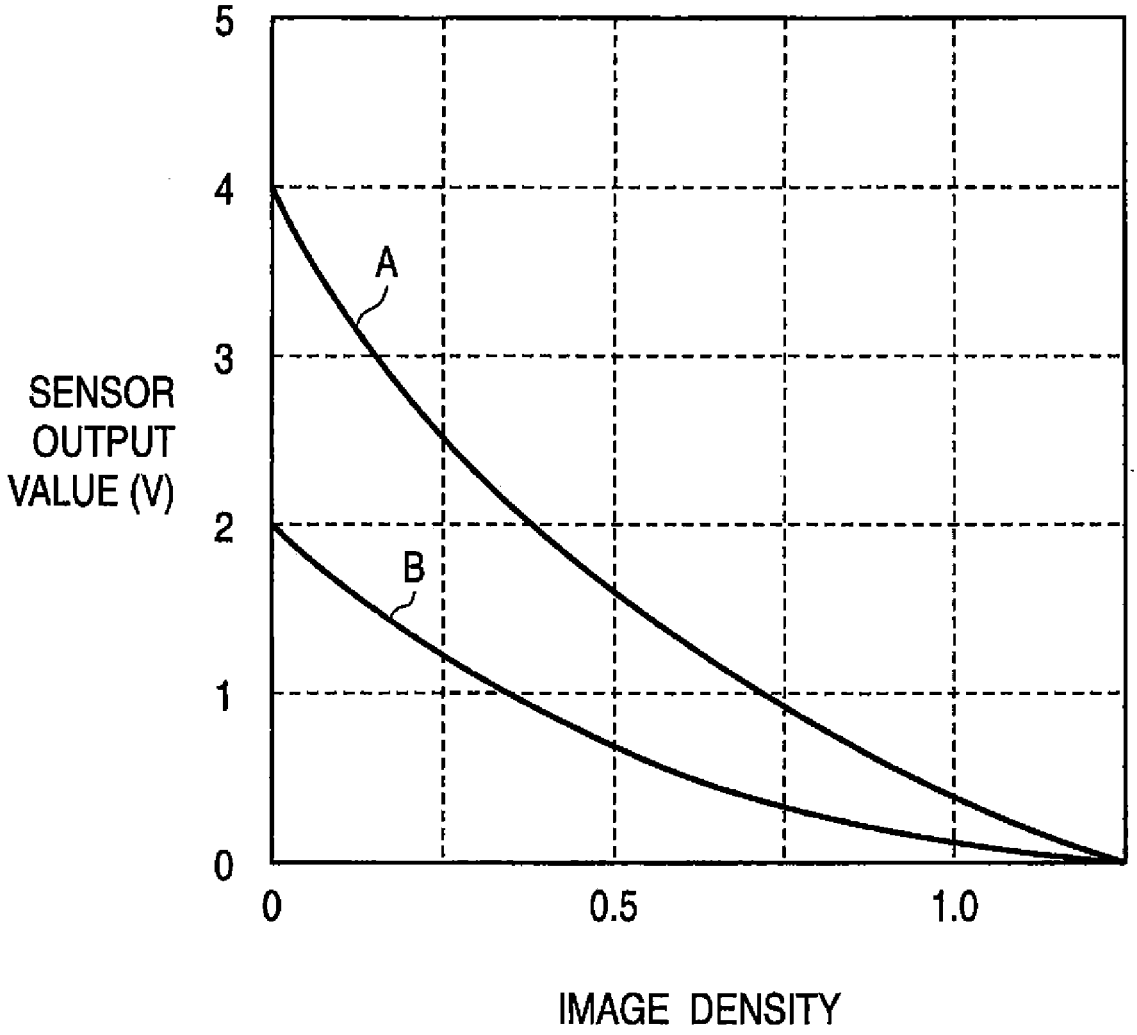
FIG. 4 is a diagram showing the relationship between the output value from a density detecting sensor 120 and the amount of toner.

FIG. 4 is a diagram showing the relationship between the output value from the density detecting sensor 120 and the amount of toner. The vertical axis represents an output value (voltage) of the density detecting sensor 120. The horizontal axis represents the image forming density (corresponding to the amount of toner). Herein, it is assumed that the maximum output voltage of the density detecting sensor 120 is 5 V.

In FIG. 4, a curved line A represents the output characteristics in a case where the density detecting sensor 120 is not dirty and where the ETB 110 is not dirty and its glossiness has not been lowered. On the other hand, a curved line B represents the output characteristics in a case where the density detecting sensor 120 is dirty.

Comparing these lines, it will be appreciated that the output voltage of the curved line B is lower than that of the curved line A. In this manner, if the surface of the density detecting sensor 120 or the ETB 110 is dirty, then the output voltage is lowered. Thus, it is preferable that output from the density detecting sensor 120 is corrected using an output value (base output value) from the density detecting sensor 120 obtained by detecting the ETB 110 on which no toner is present. More specifically, an output value regarding a test image is normalized based on the base output value (output value at the density 0 in FIG. 4) of the ETB 110. Herein, the base output value is detected while the ETB 110 rotates a first lap, and the density of the test image is detected in a second lap.

<Image Density Control>

Herein, D-max control and D-half control are described as one example of the image density control. The D-max control is a process for adjusting processing conditions, such as a developing bias and a charge bias, to a preferable state. The D-half control is a process for adjusting the density tone characteristics of an image to a preferable state. The D-half control is performed using the processing conditions that have been determined in the D-max control.

<D-Max Control>

Figure 5:
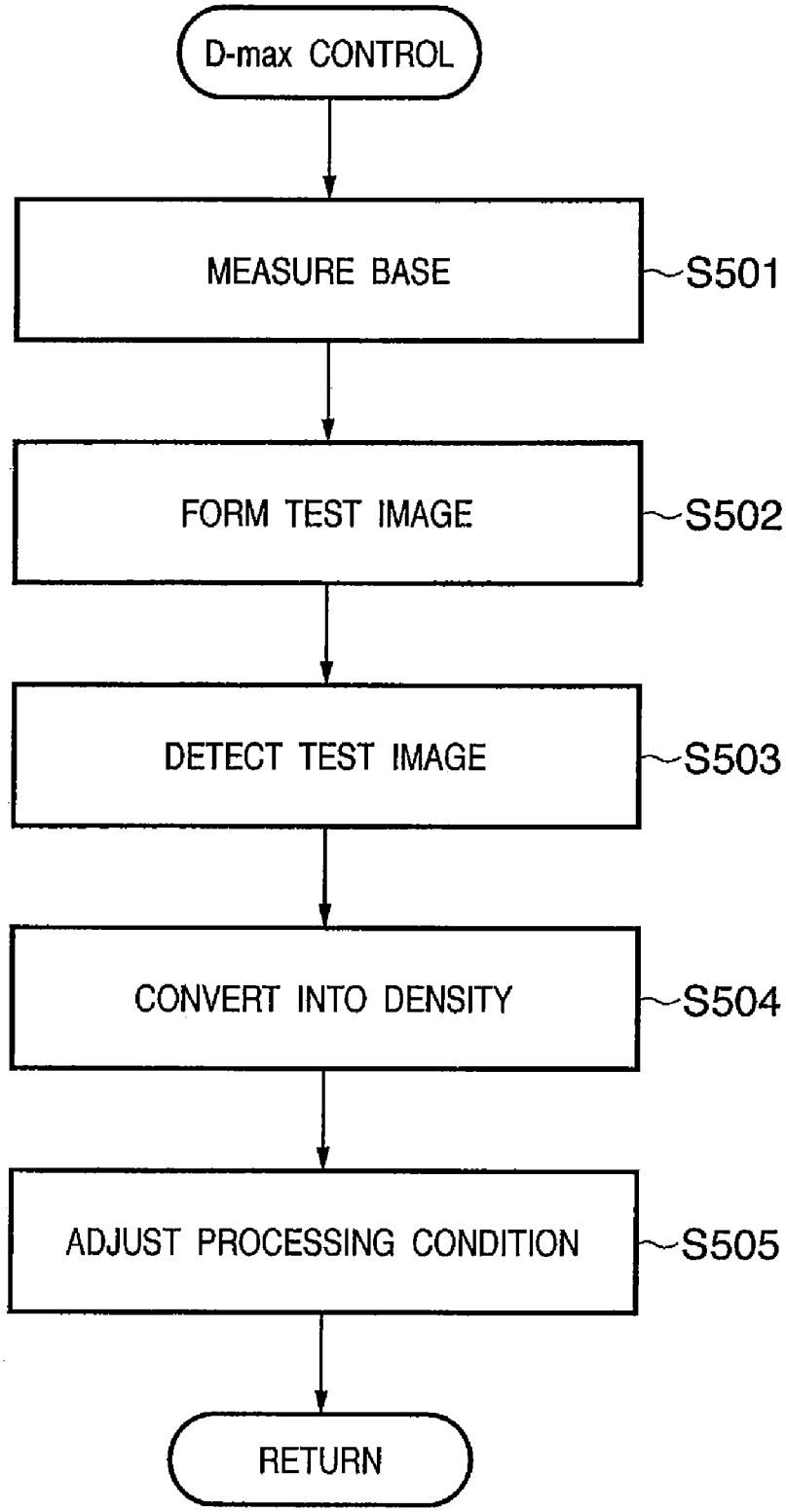
FIG. 5 is a flowchart showing one example of D-max control according to the embodiment.

FIG. 5 is a flowchart showing one example of D-max control according to this embodiment. In step S501, the control part 212 performs a base measurement of the ETB 110 using the density detecting sensor 120. It will be appreciated that no toner image is formed on the ETB 110. Herein, measurement positions and the number of the measurement positions in the base measurement are the Same as positions at which test images are formed and the number of test images used in the image density control.

In step S502, the control part 212 forms test images on the ETB 110 by controlling the image forming part 101. In this case, the control part 212 reads out image data of the test images from the storing part 214, and sends the image data to the image forming controller 200.

Figure 6:
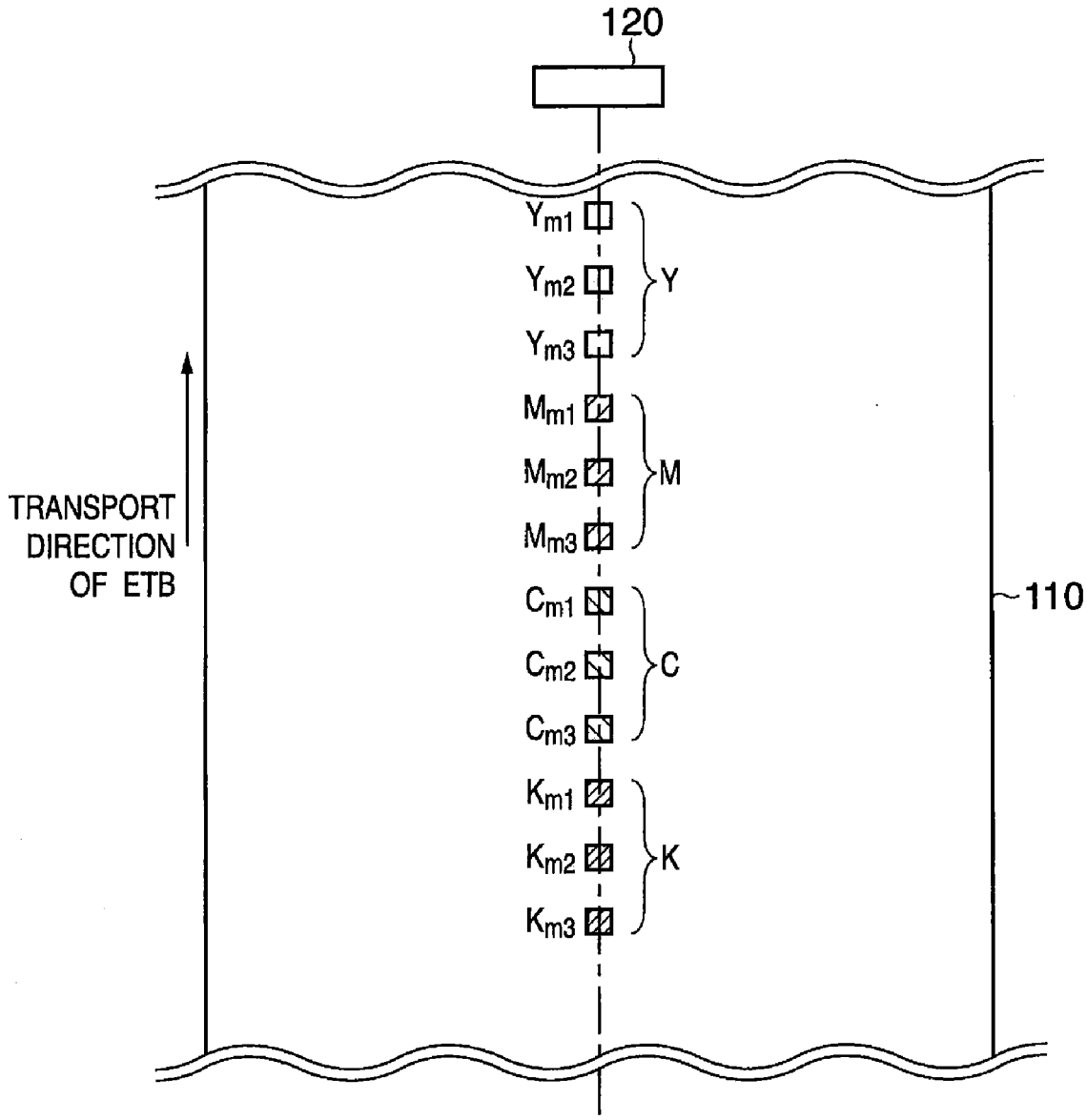
FIG. 6 is a view showing one example of test images for the D-max control formed on an electrostatic transfer belt (ETB).

FIG. 6 is a view showing one example of test images for the D-max control formed on the ETB. On the ETB 110, three test images with a size of 8 mm square are formed with an interval of 12 mm interposed therebetween for each color. Thus, 12 test images are formed in total. Herein, the three test images for each color have respectively different developing biases. In the test images, a checkered pattern with a coverage rate of 50% is used. As is well known, the checkered pattern refers to a pattern in which dots with the densities 100% and 0% are alternately repeated. The correspondence between the test images and the developing biases is as follows: Ym1, Mm1, Cm1, and Km1=−210 V; Ym2, Mm2, Cm2, and Km2=−260 V; and Ym3, Mm3, Cm3, and Km3=−310 V. More specifically, the control part 212 sets these developing biases for the high-voltage power supply circuit 215.

In step S503, the control part 212 lets the density detecting sensor 120 detect the amount of reflection light from the test images. In step S504, the control part 212 converts the detected amount of reflection light into density data.

For example, the control part 212 divides output values regarding the test images from the density detecting sensor 120 by the base output value. Accordingly, the output values from the density detecting sensor 120 are normalized. Next, the control part 212 converts the normalized output values (amount of reflection light) into density data using a density conversion table stored in the storing part 214.

In step S505, the control part 212 adjusts the processing conditions based on the acquired density data. Although density adjustment only for cyan is described in this specification, the adjustment is performed also for magenta, yellow, and black in a similar manner.

Figure 7:
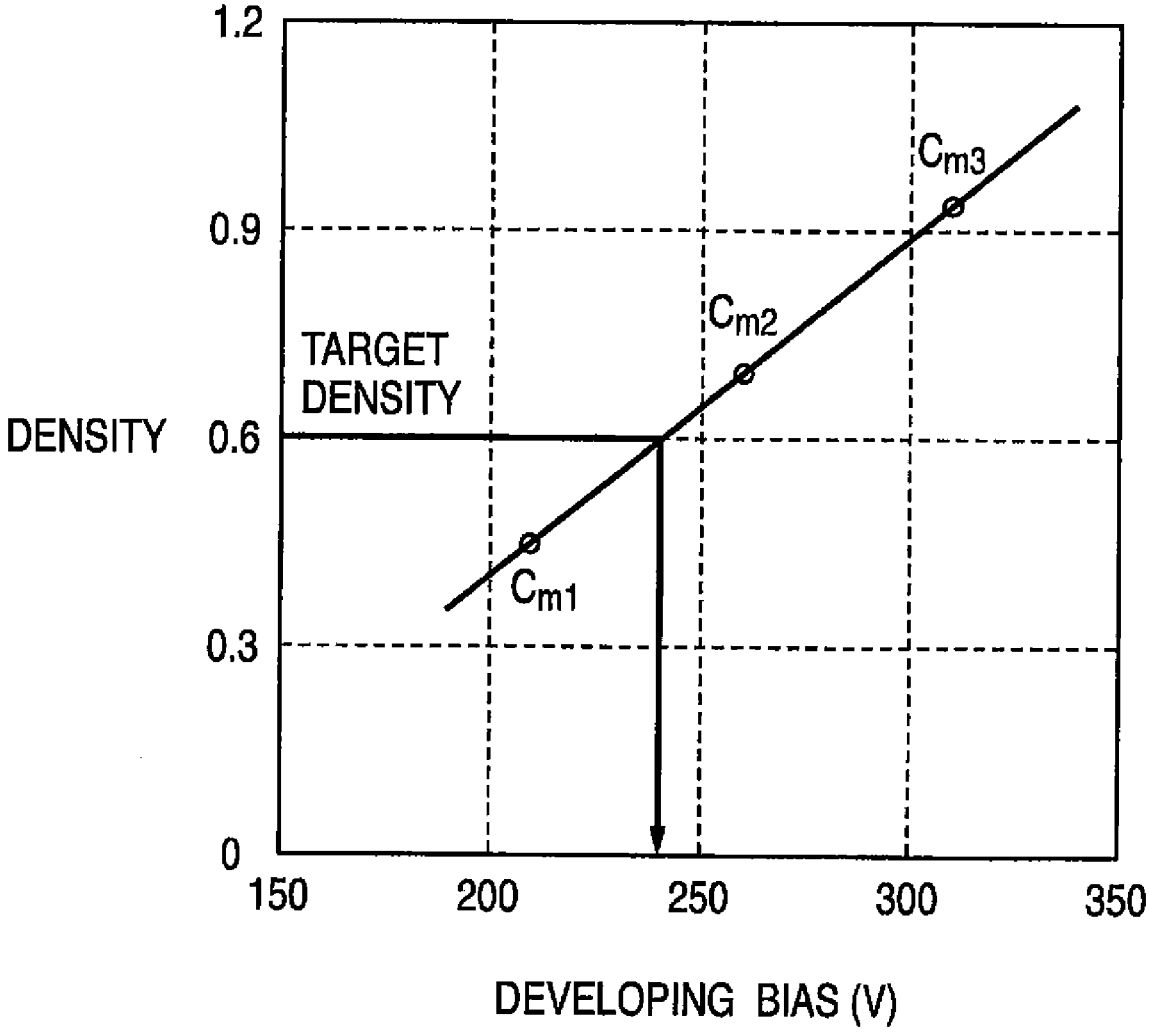
FIG. 7 is a diagram showing the correspondence between the density and the developing bias.

FIG. 7 is a diagram showing the correspondence between the density and the developing bias. The horizontal line represents the developing bias. The vertical line represents density data detected by the density detecting sensor 120. The plots in the drawing represent the density data corresponding to the test images Cm1, Cm2, and Cm3. Furthermore, in this embodiment, a density target value of the D-max control is set to 0.6, for example.

Herein, the control part 212 calculates the developing bias for obtaining the target density value, by comparing the density data of the test images and the target density value. In FIG. 7, the target density value 0.6 is positioned between Cm1 and Cm2. Thus, the control part 212 performs a linear interpolation between Cm1 and Cm2, and calculates the developing bias based on the equation for a straight line obtained by the linear interpolation. In the example shown in FIG. 7, the developing bias is −240 V.

The D-max control according to this embodiment has been described. The developing bias was used as the processing condition in this example, but the present invention is not limited to this. For example, it is also possible to adopt processing conditions, such as the charge bias and the beam scanning amount.

<D-Half Control>

Figure 8:
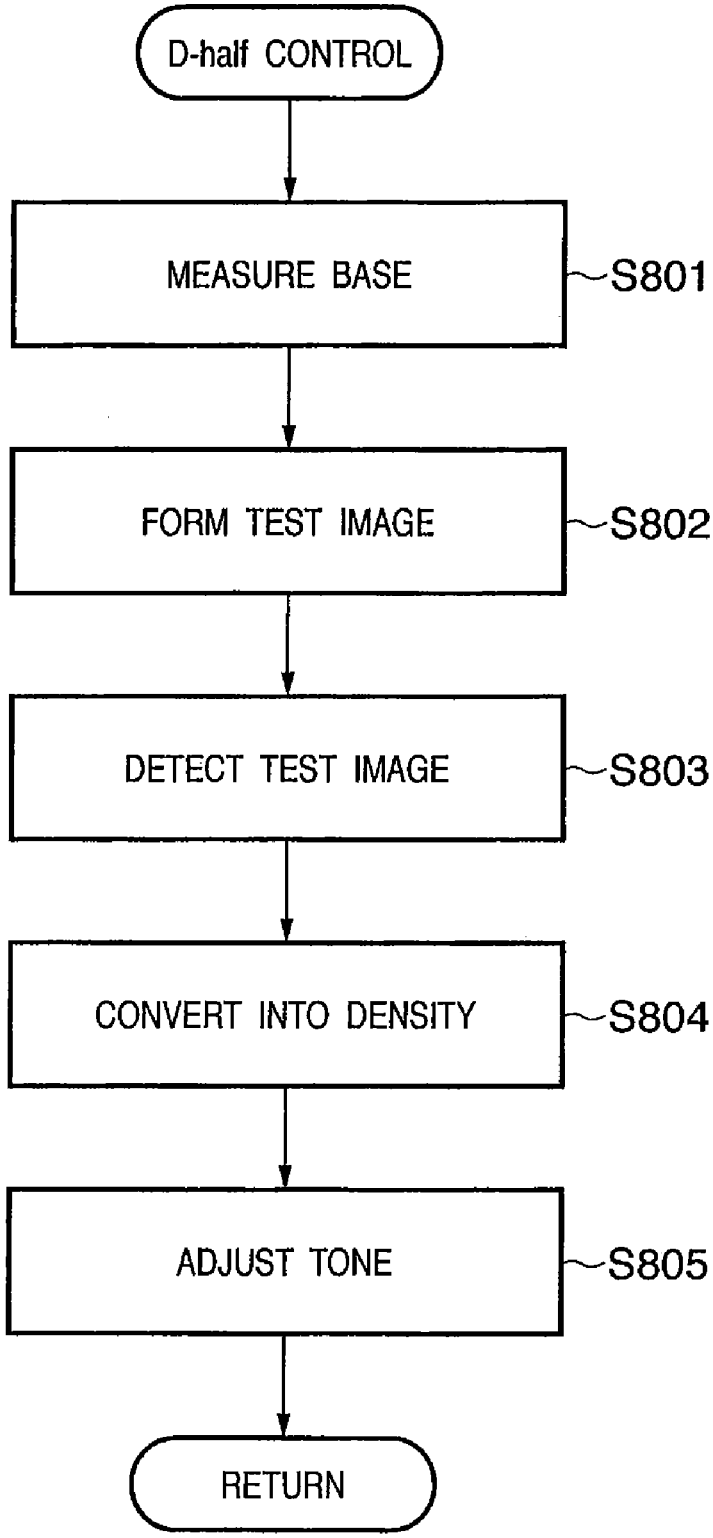
FIG. 8 is a flowchart showing one example of D-half control according to the embodiment.

FIG. 8 is a flowchart showing one example of D-half control according to this embodiment. In step S801, the control part 212 performs a base measurement of the ETB 110 using the density detecting sensor 120. It will be appreciated that no toner image is formed on the ETB 110. Herein, measurement positions and the number of the measurement positions in the base measurement are the same as positions at which test images are formed and the number of test images used in the image density control.

In step S802, the control part 212 forms test images on the ETB 110 by controlling the image forming part 101. In this case, the control part 212 reads out image data of the test images from the storing part 214, and sends the image data to the image forming controller 200.

Figure 9:
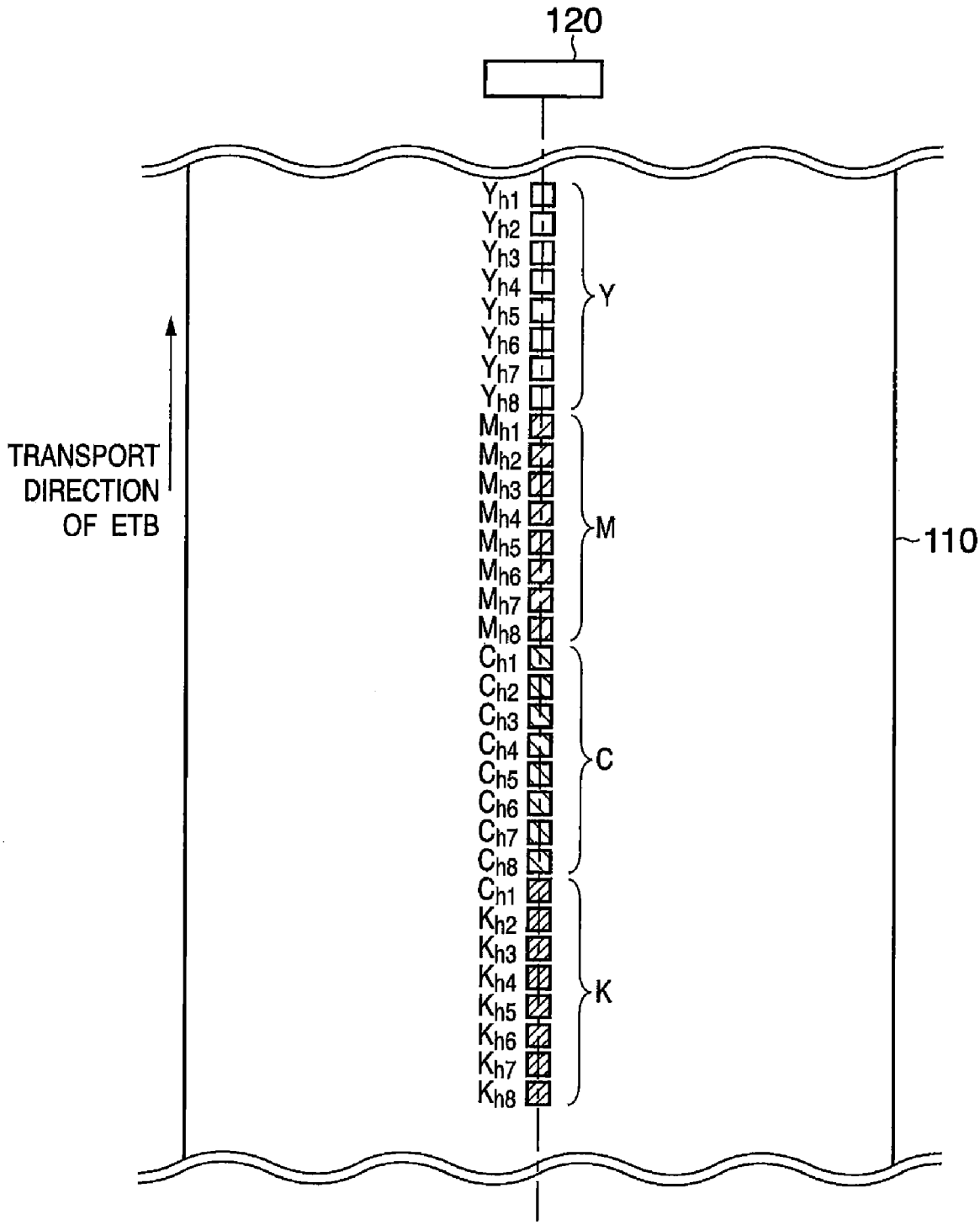
FIG. 9 is a view showing one example of test images for the D-half control formed on the ETB.

FIG. 9 is a view showing one example of test images for the D-half control formed on the ETB. At the position corresponding to the density detecting sensor 120, eight test images with a size of 8 mm square are formed with an interval of 2 mm interposed therebetween for each color. Thus, 32 test images are formed in total. Furthermore, the base measurement of the ETB 110 is performed at the positions where these 32 test images are to be formed.

Herein, the control part 212 forms eight test images with respectively different coverage rates (density tone degrees) for each of the colors Y, M, C, and K. The correspondence between the test images and the coverage rates is as follows: Yh1, Mh1, Ch1, and Kh1=12.5%; Yh2, Mh2, Ch2, and Kh2=25%; Yh3, Mh3, Ch3, and Kh3=37.5%; Yh4, Mh4, Ch4, and Kh4=50%; Yh5, Mh5, Ch5, and Kh5=62.5%; Yh6, Mh6, Ch6, and Kh6=75%; Yh7, Mh7, Ch7, and Kh7=87.5%; and Yh8, Mh8, Ch8, and Kh8=100%.

In step S803, the control part 212 lets the density detecting sensor 120 detect the amount of reflection light from the test images. In step S804, the control part 212 converts the detected amount of reflection light (output values from the density detecting sensor 120) into density data. The conversion process to the density data is as described in step S504. In step S805, the control part 212 performs the tone control (tone adjustment) based on the acquired density data.

Figure 10:
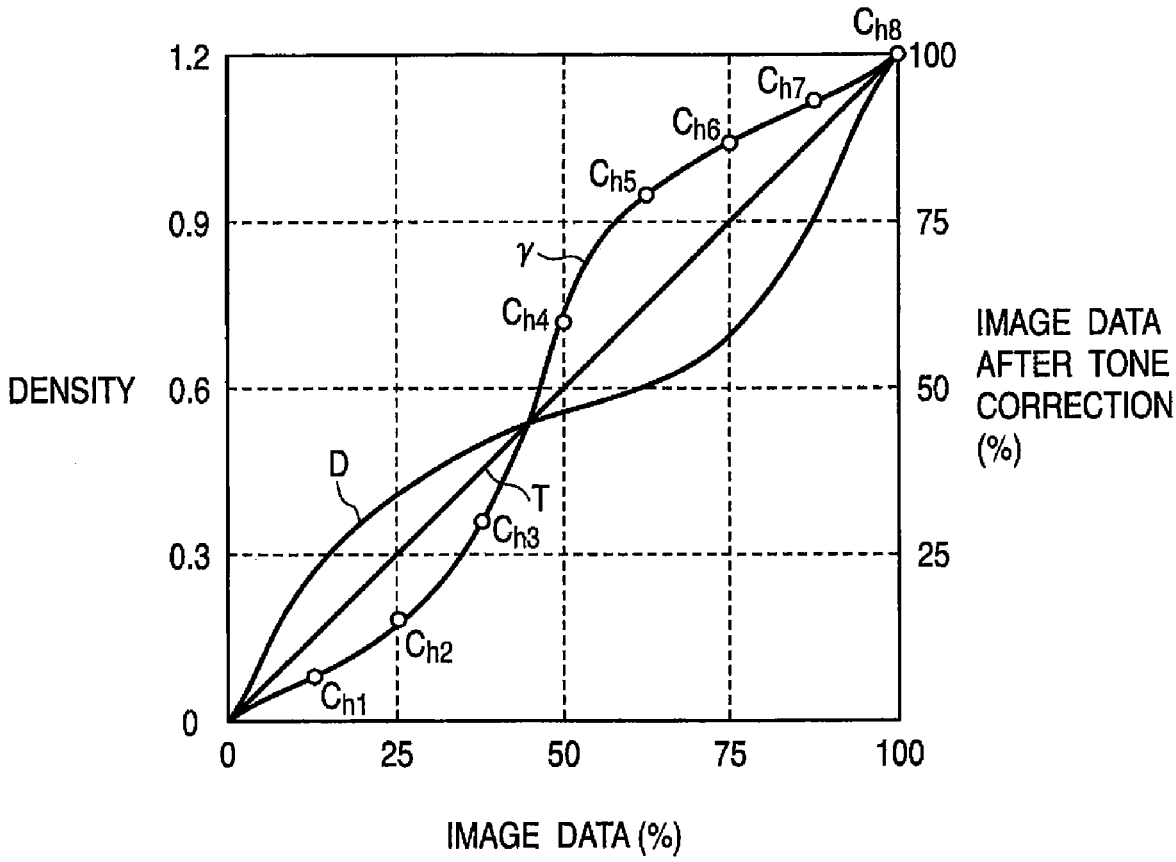
FIG. 10 is a diagram illustrating one example of tone adjustment according to the embodiment.

FIG. 10 is a diagram illustrating one example of tone adjustment according to this embodiment. Although tone adjustment is described only for cyan in this specification, the tone adjustment is performed also for magenta, yellow, and black in a similar manner. In FIG. 10, the horizontal axis represents the image data. The vertical axis represents density data detected by the density detecting sensor 120. The plots in the drawing represent the density data corresponding to the test images Ch1, Ch2, Ch3, Ch4, Ch5, Ch6, Ch7, and Ch8.

Herein, a straight line T represents the target tone characteristics of the image density control. In this embodiment, the target tone characteristics T are set such that the relationship between the image data and the density data is proportional. A curved line γ represents the tone characteristics in a state where the tone adjustment is not performed. Herein, the density data is obtained only from the test images Ch1, Ch2, Ch3, Ch4, Ch5, Ch6, Ch7, and Ch8. Thus, the curved line γ is obtained by performing spline-interpolation between these pieces of density data.

The curved line D represents a tone correction table (example: the γ-correction table) that is calculated in this control, The γ-correction table is calculated by obtaining points that are symmetrical to points on the curved line γ with respect to the target tone characteristics T. The γ-correction table may be calculated by either the control part 212 or the γ-correcting part 203. The γ-correcting part 203 corrects image data using the γ-correction table 205 at the time of image formation. Accordingly, the target tone characteristics are obtained.

<Performance Control on a Plurality of Image Density Control Modes>

As described above, the image forming apparatus 100 has two printing modes, that is, the normal speed mode for forming an image on plain paper, and the lower speed mode for forming an image on cardboard.

Herein, dark decay and light decay on the photosensitive drum vary as the processing speed varies. It will be appreciated that the development characteristics and the like also vary. Accordingly, it is preferable to perform the image density control in each of the normal speed mode and the lower speed mode.

However, when the image density control is performed each time for every image forming mode, the downtime is increased. Thus, in this embodiment, the performing time intervals of the image density control corresponding to the image forming modes are made different from each other, and thus the downtime and the toner consumption amount are reduced.

Figure 11:
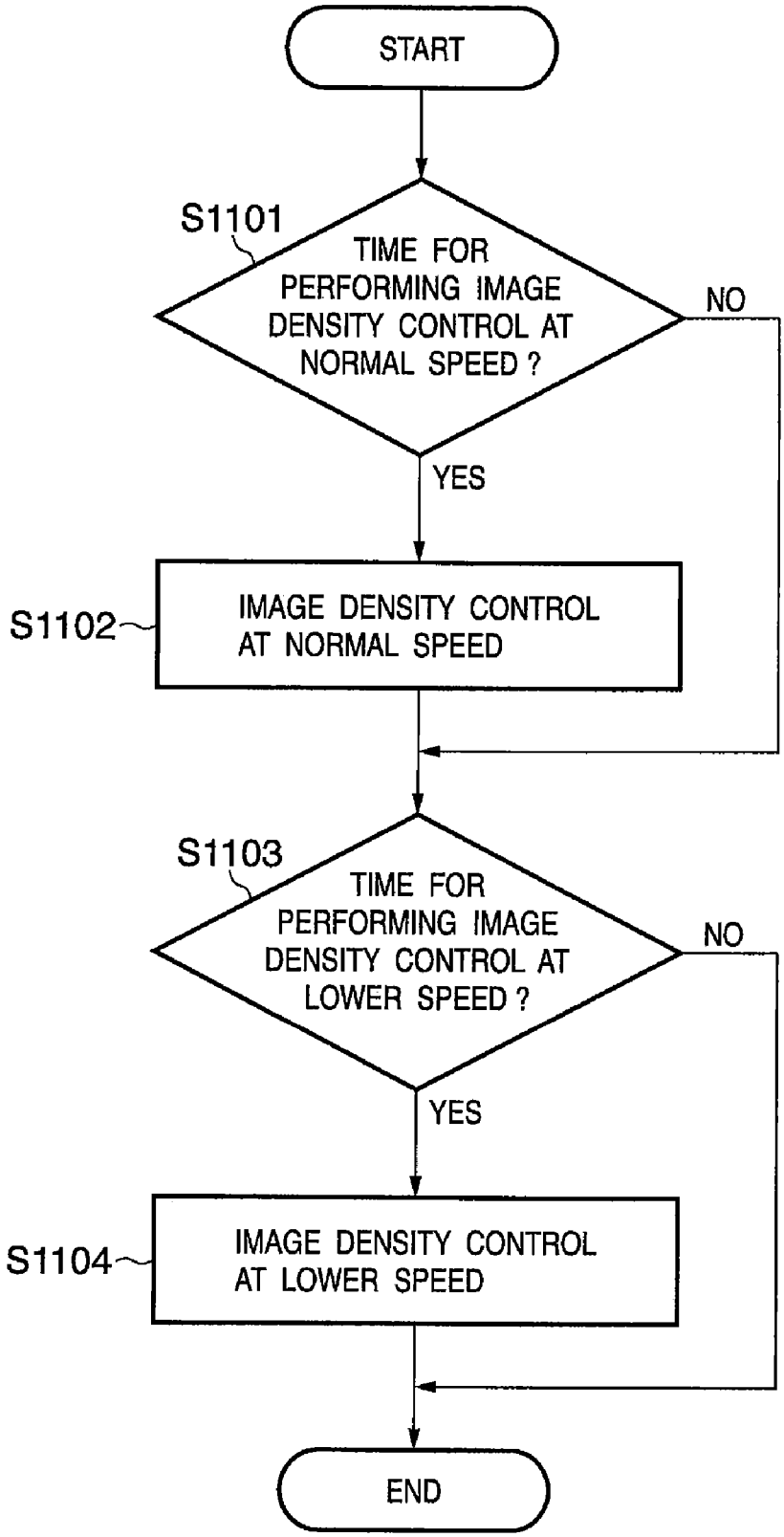
FIG. 11 is a flowchart showing image density control according to a first embodiment of the invention.

FIG. 11 is a flowchart showing image density control according to the first embodiment of the invention. In step S1101, the control part 212 judges whether or not it is time for performing the image density control in the normal speed mode. Herein, the image density control mode that is performed in the normal speed mode is referred to as an image density control mode for plain paper. Examples of the image density control include the D-max control and the D-half control.

FIG. 12 is a diagram showing the relationship between the number of pages on which images are formed and fluctuation in the tone characteristics in the normal speed mode. "G" (GOOD) refers to a state in which the tone characteristics have no problem. "P" (POOR) refers to a state in which the tone characteristics have a slight problem. "I" (UNACCEPTABLE) refers to a state in which the tone characteristics have a significant problem. FIG. 12 shows that the tone characteristics come to have a problem when the number of pages on which images are formed exceeds approximately 150.

FIG. 13 is a diagram showing the relationship between the number of pages on which images are formed and fluctuation in the tone characteristics in the lower speed mode. FIG. 13 shows that the tone characteristics come to have a problem when the number of pages on which images are formed reaches approximately 250 to 300. Furthermore, by comparing FIGS. 12 and 13, it can be said that the tone characteristics in the lower speed mode are relatively more stable than the tone characteristics in the normal speed mode. Accordingly, the performing time interval for the image density control in the lower speed mode may be longer than the performing time interval for the image density control in the normal speed mode.

In this embodiment, the image density control is performed at the moment that the tone characteristics are expected to fluctuate. For example, the performance timings may be as follows.

1. When the power of the image forming apparatus 100 is turned on.
2. When the developing unit or the photosensitive drum 105 is changed.
3. When the period during which the image forming apparatus 100 is not used exceeds a predetermined threshold value (example: six hours).
4. When the number of pages on which images are formed reaches a predetermined threshold value (example: 100 pages in the normal speed mode, 230 pages in the lower speed mode).

The control part 212 counts the number of pages on which images are formed, and stores the counted number of pages on which images are formed in the storing part 214. The threshold value for each image forming mode is also stored in the storing part 214. If it is judged that it is not time for the image density control, then the procedure proceeds to step S1103. If it is judged that it is time for the image density control, then the control part 212 performs the image density control in the normal speed mode in step S1102.

In step S1103, the control part 212 judges whether or not it is time for performing the image density control in the lower speed mode. Herein, the image density control mode that is performed in the lower speed mode is referred to as an image density control mode for cardboard. As described above, the performing time interval for the image density control that is performed in the lower speed mode may be relatively longer than the performing time interval for the image density control that is performed in the normal speed mode. Thus, it is necessary that the performing time interval for the image density control that is performed in the normal speed mode is relatively shorter than the performing time interval for the image density control that is performed in the lower speed mode.

If it is judged that it is not time for the image density control, then the control part 212 ends the image density control in this flowchart. If it is judged that it is time for the image density control, then the control part 212 performs the image density control in the lower speed mode in step S1104.

According to this embodiment, the performing time interval for the image density control in the normal speed mode is different from the performing time interval for the image density control in the lower speed mode. In other words, the image density control is not performed each time in all image forming modes, and thus downtime caused by the image density control is shortened. Furthermore, the total amount of toner consumed in the image density control is made smaller than that in the case where the image density control is performed each time in all image forming modes.

Furthermore, the processing speed in the lower speed mode is lower than the processing speed in the normal speed mode. In this case, as shown in FIGS. 12 and 13, the image density characteristics in the lower speed mode are more durable than the image density characteristics in the normal speed mode. Thus, the control part 212 can make the performing time interval for the image density control in the lower speed mode longer than the performing time interval for the image density control in the normal speed mode. Accordingly, the downtime and the toner consumption amount can be preferably reduced.

Second Embodiment

In the first embodiment, with respect to the image density control that was to be performed for each of a plurality of image forming modes, the image forming modes were respectively provided with different performing time intervals, and thus the downtime and the like were improved. In the second embodiment of the invention, if the image density control is performed in one image forming mode and is not performed in the other image forming mode, it is an object of this embodiment to keep a preferable color balance in the latter image forming mode.

Herein, a user may give a command to start the image density control for each image forming mode using an operation part (not shown). For example, if the user changes the setting from "enable" image density control to "disable", then the image density control is not performed at all until the user further changes the setting to "enable". In this case, the performing time interval for the image density control may be inappropriately long. More specifically, the image forming conditions that were determined in the image density control performed last time are continuously used. It will be appreciated that the color balance is shifted as the number of pages on which images are formed increases.

Figure 14:
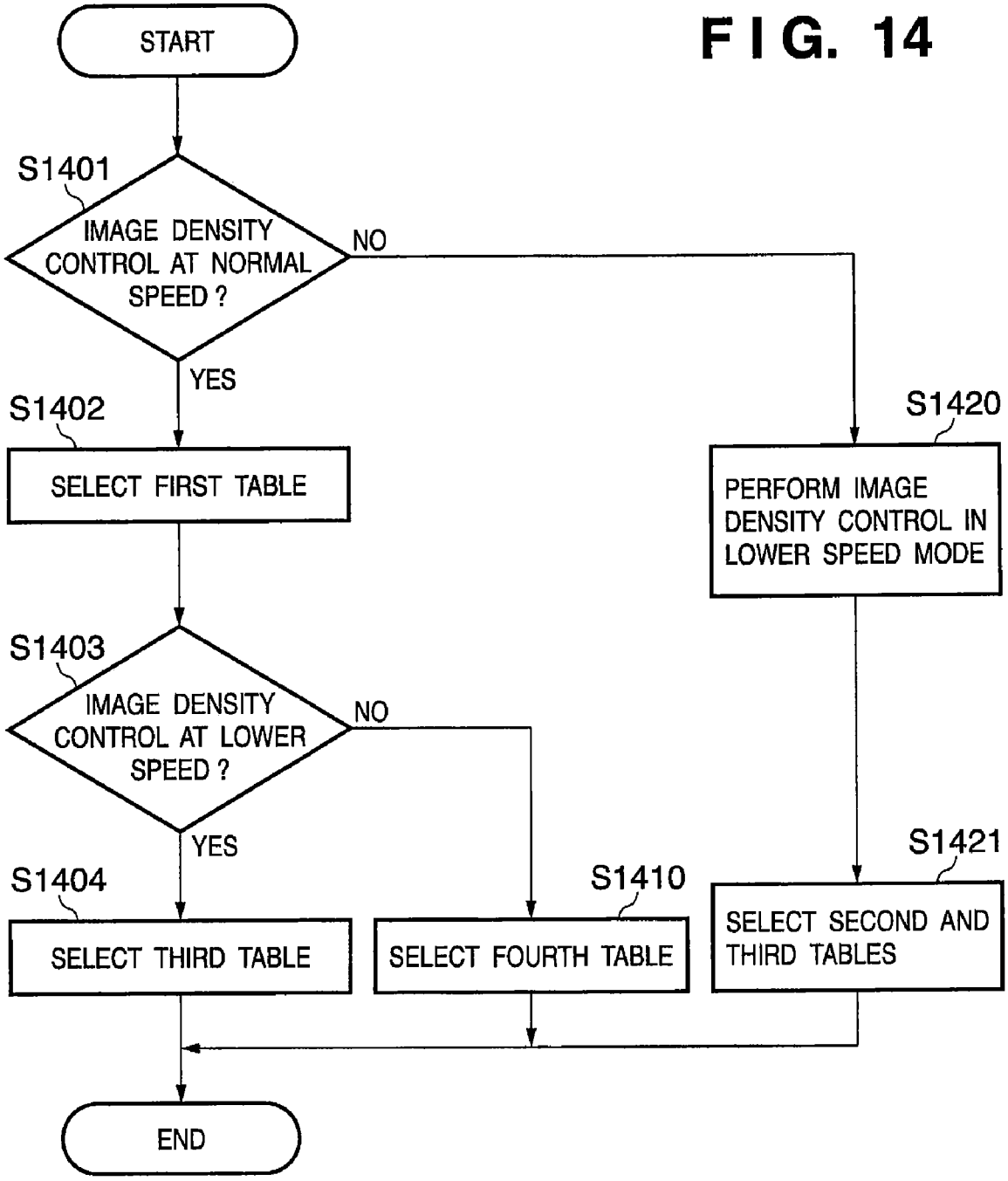
FIG. 14 is a flowchart showing image density control according to a second embodiment of the invention.

FIG. 14 is a flowchart showing image density control according to the second embodiment. In step S1401, the control part 212 judges whether or not the image density control has been performed in the normal speed mode.

If the image density control in the normal speed mode has been performed, then the procedure proceeds to step S1402, where the control part 212 selects a first table. The first table is used for determining image forming conditions for the normal speed mode, based on the results of the image density control that has been performed in the normal speed mode. The first table is stored in the storing part 214 in advance. The control part 212 determines the image forming conditions for the normal speed mode based on the selected first table.

In step S1403, the control part 212 judges whether or not the image density control in the lower speed mode has been performed in the lower speed mode. If the image density control has been performed, then the procedure proceeds to step S1404, where a third table is selected. The third table is used for determining image forming conditions for the lower speed mode, based on the results of the image density control that has been performed in the lower speed mode. The third table is stored in the storing part 214 in advance. The control part 212 determines the image forming conditions for the lower speed mode based on the selected third table.

On the other hand, if it is judged in step S1403 that the image density control has not been performed in the lower speed mode, then the procedure proceeds to step S1410. In step S1410, the control part 212 selects a fourth table. The fourth table is used for determining image forming conditions for the lower speed mode, based on the results of the image density control that has been performed in the normal speed mode. The fourth table is also stored in the storing part 214 in advance. The control part 212 determines the image forming conditions for the lower speed mode based on the selected fourth table.

If it is judged in step S1401 that the image density control has not been performed in the normal speed mode, then the procedure proceeds to step S1420. In step S1420, the control part 212 performs the image density control in the lower speed mode.

In step S1421, the control part 212 selects a second table and the third table. The second table is used for determining image forming conditions for the normal speed mode, based on the results of the image density control that has been performed in the lower speed mode. The second table is also stored in the storing part 214 in advance. The control part 212 determines the image forming conditions for the normal speed mode based on the selected second table. Furthermore, the control part 212 determines the image forming conditions for the lower speed mode based on the selected third table.

Herein, the second and the fourth tables are tables with which based on the results of the image density control performed in one image forming mode, image forming conditions for the other image forming mode are to be predicted or estimated. Accordingly, the precision in the control may be lower than that in the case where the first or the third table is used. However, even if the performing time interval for the image density control in one image forming mode is inappropriately long, it is possible to keep the color balance and the like preferable to some extent. However, it would be preferable to periodically perform the image density control in at least one image forming mode.

According to the second embodiment, even if the performing time interval for the image density control in one image forming mode becomes inappropriately long, it is possible to keep the color balance and the like preferable. More specifically, it is possible to keep the color balance in one image forming mode preferable by utilizing the results of the image density control performed in the other image forming mode that has been performed as appropriate.

The concept of the first embodiment described above and the concept of the second embodiment may be combined as long as they do not contradict each other. For example, in step S1102, the control part 212 may select the fourth table in order to determine the image forming conditions for the lower speed mode. Furthermore, in step S1104, the control part 212 may select the second table in order to determine the image forming conditions for the normal speed mode. Accordingly, the performing time intervals for the image density controls in the image forming modes can be longer than the respective performing time intervals in the first embodiment.

It should be noted that the present invention is not affected by the image forming method. For example, the present invention can be applied also to an image forming apparatus using an intermediate transferring member. Furthermore, the present invention can be preferably applied also to an image forming apparatus that forms a color image using one photosensitive drum (image carrier).

Third Embodiment

Generally, image forming apparatuses have a plurality of operation modes with respectively different processing speeds. Examples of the operation modes include a normal mode for performing standard printing, and a lower speed mode with a lower processing speed than that in the normal mode. The lower speed mode is used when performing printing on an OHT (overhead transparency) sheet or on cardboard.

In image forming apparatuses, the image forming density and the character width, for example, may deviate from desired values depending on factors, such as the usage environment. In order to address this deviation, a method has been proposed in which based on the density of a patch image formed on the intermediate transfer belt or the like, the correspondence between image forming parameters (conditions, such as the charge bias, the developing bias, and the transfer bias) and the image forming density is adjusted (Japanese Patent Application Laid-Open No. 2001-343867 and 2002-082500).

It is known that the tint is changed if the tone reproductivity of each color in a color printer is unstable. In order to address this change, it is preferable to adjust the correspondence between the image processing parameters regarding the tone and actual tones, by forming a plurality of patch images with respectively different tones and detecting their densities.

However, the processing speed in the lower speed mode usually is approximately ½ to ¼ of the processing speed in the normal mode. Thus, parameters that have been optimized for the normal mode cannot be adopted without any processing in the lower speed mode. If they were adopted, then the image forming density and the tint would become less appropriate than those in the normal mode. Accordingly, it is necessary to adjust the parameters for the lower speed mode by detecting the density of test images formed in the lower speed mode.

However, if the parameter adjustment described above is performed each time in both the normal mode and the lower speed mode, then the time during which an image cannot be formed (downtime) is increased, and thus it is not preferable. Moreover, consumables, such as toner, will be used up more than necessary.

The present invention according to the third embodiment of the invention is preferably applied to an image forming apparatus in which the density of a test image formed on an image carrier using any one of a plurality of operation modes with respectively different processing speeds is detected, and parameters regarding the density and the tone are adjusted based on the detected density. In the image forming apparatus, based on parameters that have been determined or density data that has been detected in a first operation mode of a plurality of operation modes, it is controlled whether or not to form and detect a test image, and adjust parameters in a second operation mode of the plurality of operation modes.

According to the present invention, the parameter adjustment is not performed each time in both the first operation mode and the second operation mode, that is, the adjustment process in the second operation mode may be omitted. Thus, the downtime and the consumption amount of consumables is made smaller than that in conventional techniques in which the adjustment process is performed each time in both the first operation mode and the second operation mode.

Figure 15:
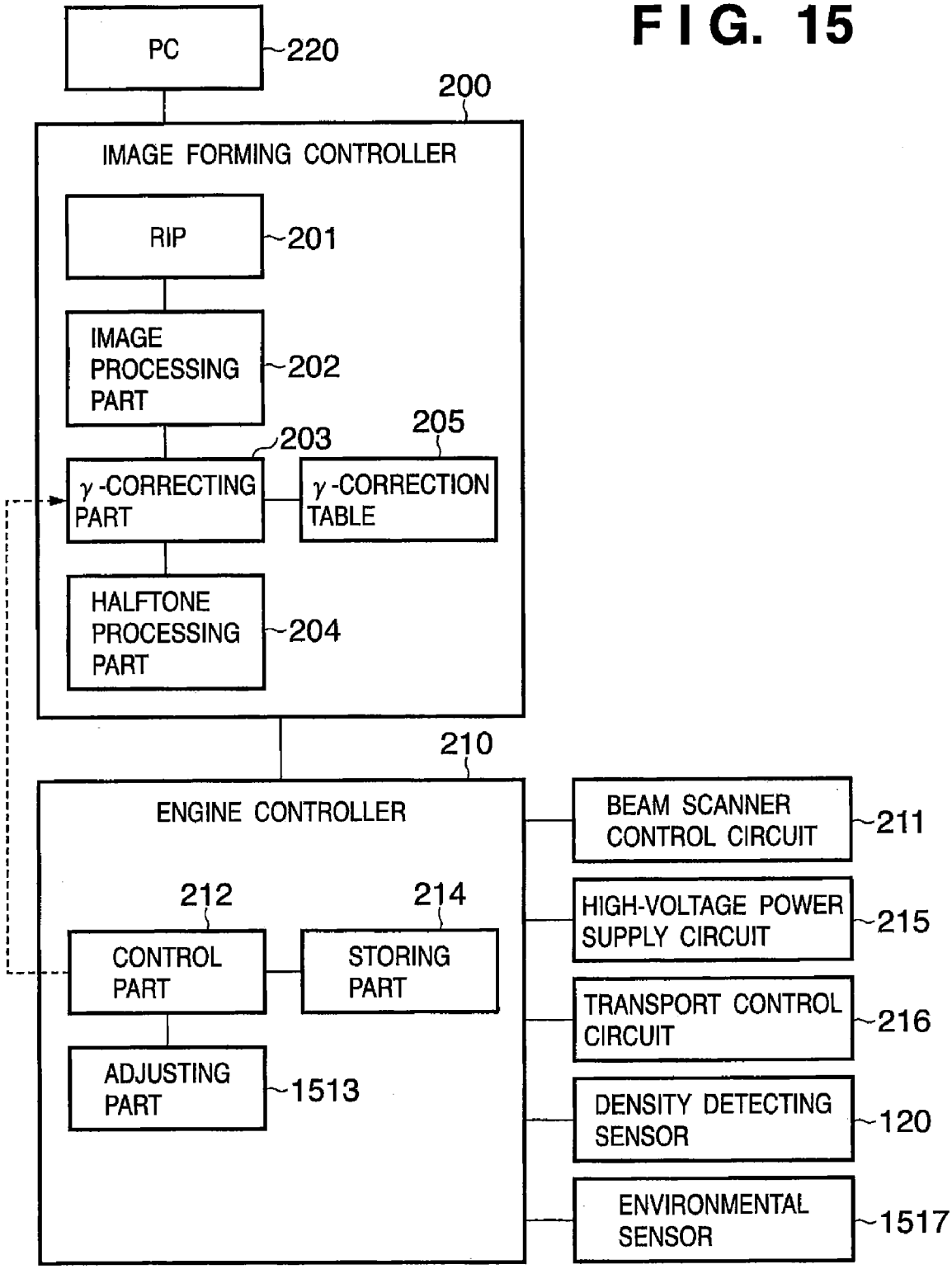
FIG. 15 is a block diagram showing a control part according to the second embodiment.

FIG. 15 is a block diagram showing one example of a control part according to this embodiment. Components described in the first embodiment are given the same reference numbers as above, and are not repeatedly described. An adjusting part 1513 adjusts parameters regarding the density of an image that is to be formed, and parameters regarding the tone of the image. For example, the adjusting part 1513 prevents imaging failures, such as fogging, by selecting an optimum imaging parameter. Furthermore, the adjusting part 1513 controls the characteristics, such as the line width and the amount of toner attached to lines, that depend on the imaging parameter. Furthermore, the control part 212 sends the tone characteristics (information of the γ-characteristics) that has been obtained in tone measurement (described later) to the γ-correcting part 203. Based on the received information of the γ-characteristics, the γ-correcting part 203 updates the γ-correction table so as to obtain the desired γ-characteristics, thereby keeping the correspondence between the tone characteristics of an image and image signals in a linear form. Hereinafter, image control refers to adjustment of at least one of parameters regarding the density of an image and parameters regarding the tone of the image. An environmental sensor 1517 is a sensor for measuring environmental parameters (example: the temperature and the humidity).

Figure 16:
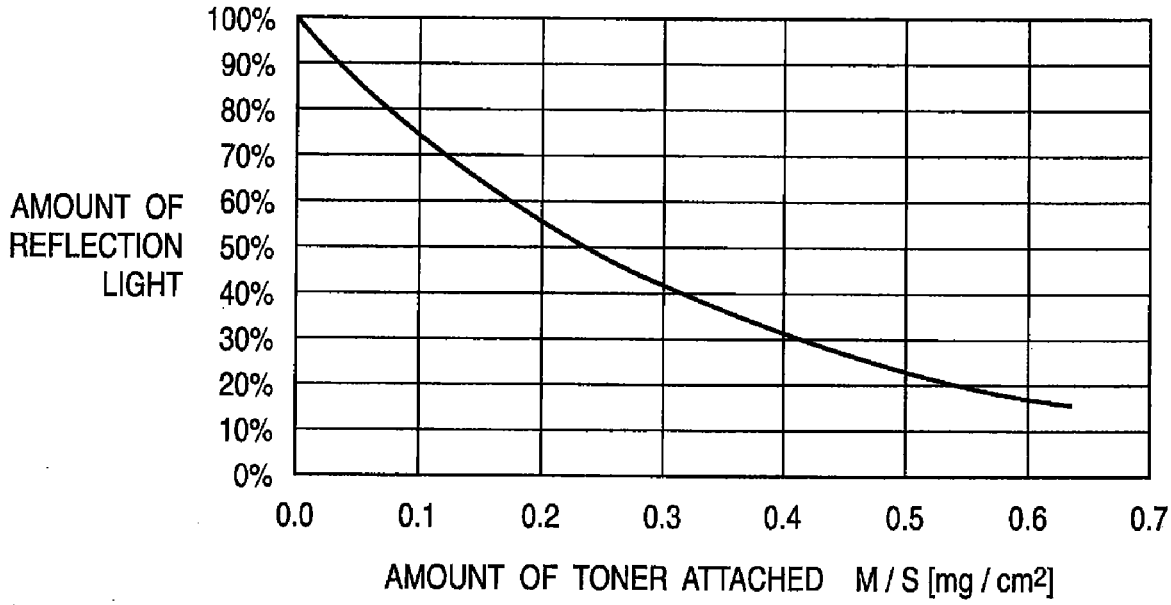
FIG. 16 is a diagram showing the relationship between the amount of toner attached and the amount of reflection light of test images formed on the ETB on a trial basis.

FIG. 16 is one example of a diagram showing the relationship between the amount of toner attached and the amount of reflection light of test images formed on the ETB on a trial basis. The amount of toner attached refers to the amount of toner attached per square centimeter, expressed in milligrams. The amount of reflection light is expressed by taking the amount of light that is incident on the light-receiving element 302 in a state where no toner is present on the ETB 110 (base portion) as 100%.

If toner of the same color is used, then the relationship between the amount of toner attached on the ETB and the toner density on a recording material is substantially constant. The correlation between the amount of toner attached on the ETB and the toner density on a recording material is listed in a table, and this table is stored in the storing part 214. Thus, the control part 212 or the adjusting part 1513 can convert the detected amount of reflection light into density data using this table.

Figure 17:
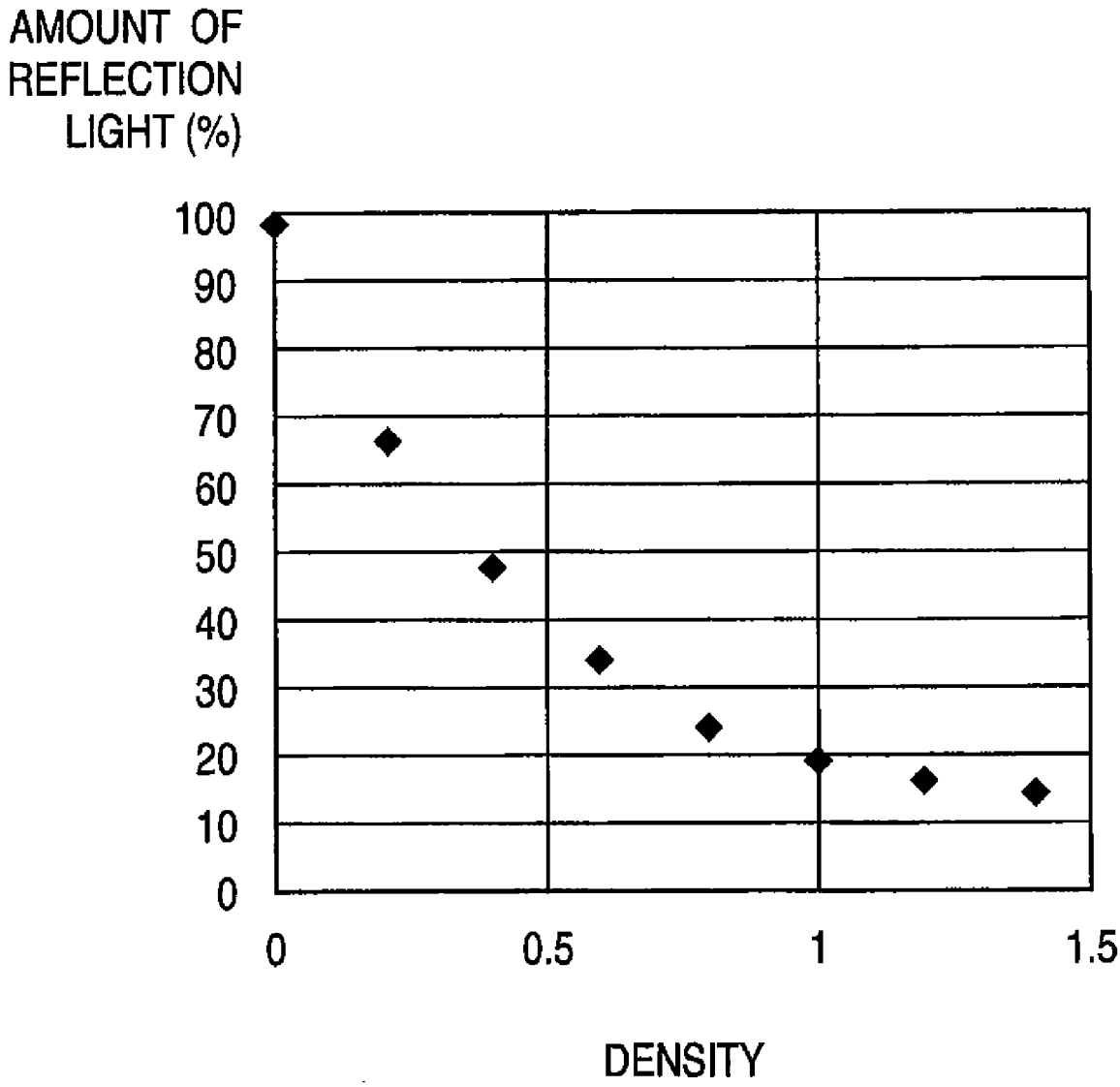
FIG. 17 is a diagram showing one example of the correlation between the amount of reflection light and the density.

FIG. 17 is a diagram showing one example of the correlation between the amount of reflection light and the density. This drawing also shows that there is the correlation between the amount of reflection light and the density.

<Density Adjustment>

When the power is turned on, when a toner cartridge (CRG) is changed, or when the number of pages on which images are formed exceeds a predetermined number of pages after the last adjustment, the control part 212 activates the adjusting part 1513. First, the adjusting part 1513 performs a density adjustment process in the normal mode. The adjusting part 1513 forms test images on the ETB 110 using three different developing biases for each color. The image forming parameters (such as DC values of the charge biases and DC values of the developing biases) are different for each test image. The adjusting part 1513 lets the density detecting sensor 120 detect the densities of the plurality of test images. Based on the detected density data, the adjusting part 1513 determines the image forming parameters (example: DC values of the developing biases) that are necessary to obtain a desired density. In this specification, these image forming parameters are referred to as density parameters.

Figure 18:
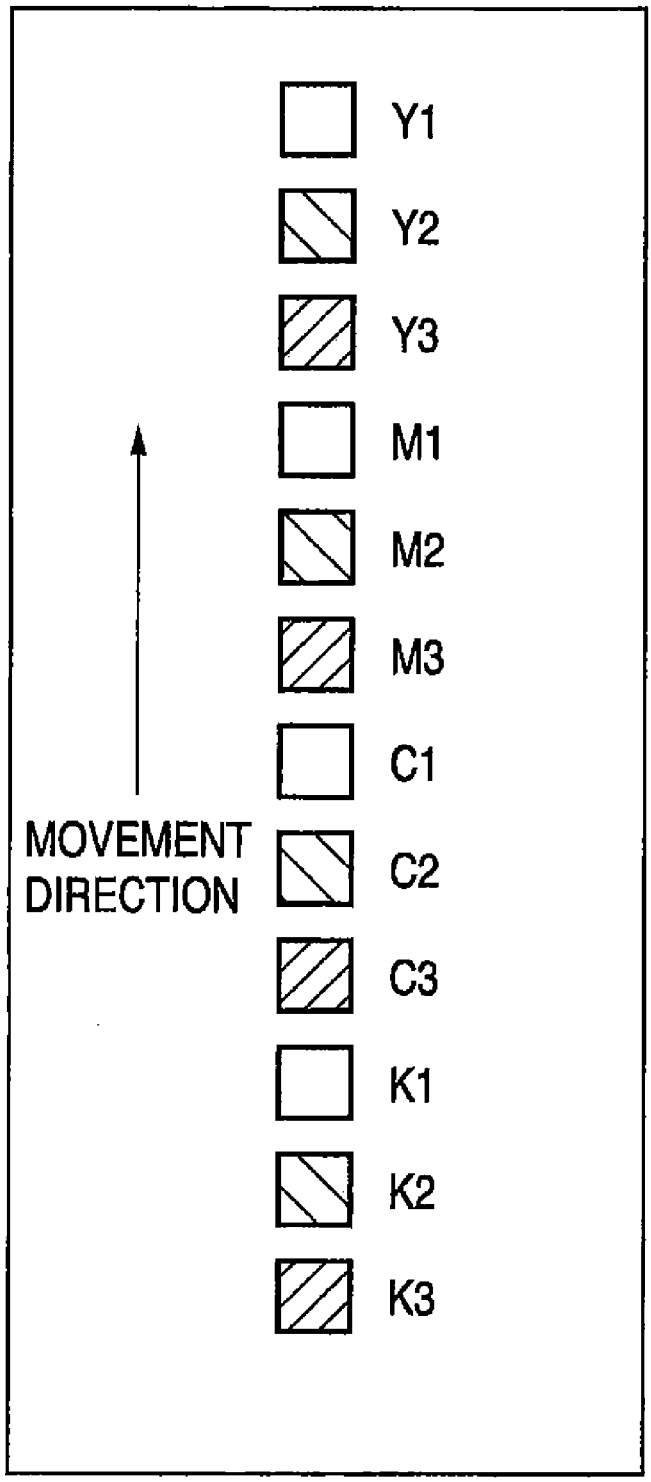
FIG. 18 is a schematic diagram in which the ETB is spread in the circumferential direction.

FIG. 18 is a schematic diagram in which the ETB is spread in the circumferential direction. Y1 to Y3 represent test images formed on the ETB 110 on a trial basis using yellow toner. Image data for forming the test images is, for example, image data of a checkered pattern in which dots with the tone 100% and dots with the tone 0% are repeated (the tone 50% in area ratio). As the test images, it is preferable to use test images that are sensitive to the density parameters, such as the developing bias and the charge bias. Generally, a pattern with a higher spatial frequency is more sensitive to the density parameters. Thus, a pattern with a large number of lines is preferable. Furthermore, test images with a higher contrast can be formed in a more stable manner. Thus, as the test images, a pattern is preferable in which a high latent potential and a low latent potential are repeated at an area ratio of approximately 50%.

In the example shown in FIG. 18, DC values of the developing biases for yellow images Y1 to Y3 are respectively set to three stages −150 V, −200 V, and −250 V, so that the density of the test images sequentially varies. Test images using magenta toner (M1 to M3), test images using cyan toner (C1 to C3), and test images using black toner (K1 to K3) are formed in similar conditions.

In this embodiment, the number of test images is three for each color, but the present invention is not limited to this. Generally, when the number of test images is increased, the number of measurement points is increased, and thus there is the advantage that the precision is improved. However, there is also the disadvantage that the time that is necessary for the parameter adjustment for each color becomes long. Accordingly, the number of test images may be determined in consideration of the trade-off between the advantage and the disadvantage.

Furthermore, it is preferable to secure a sufficient size of the test images, in consideration of the spot size of light irradiated from the density detecting sensor 120, and unevenness caused by the precision in attaching the density detecting sensor 120, for example. In this embodiment, one test image is in the shape of a 2 cm square. It would be necessary to secure a sufficient interval between the test images, in consideration of the time from when the developing bias is changed to when it is stabilized, the transport speed of the ETB 110, and unevenness caused by the precision in attaching the density detecting sensor 120, for example. In this embodiment, the interval between the test images is 1 cm.

Figure 19:
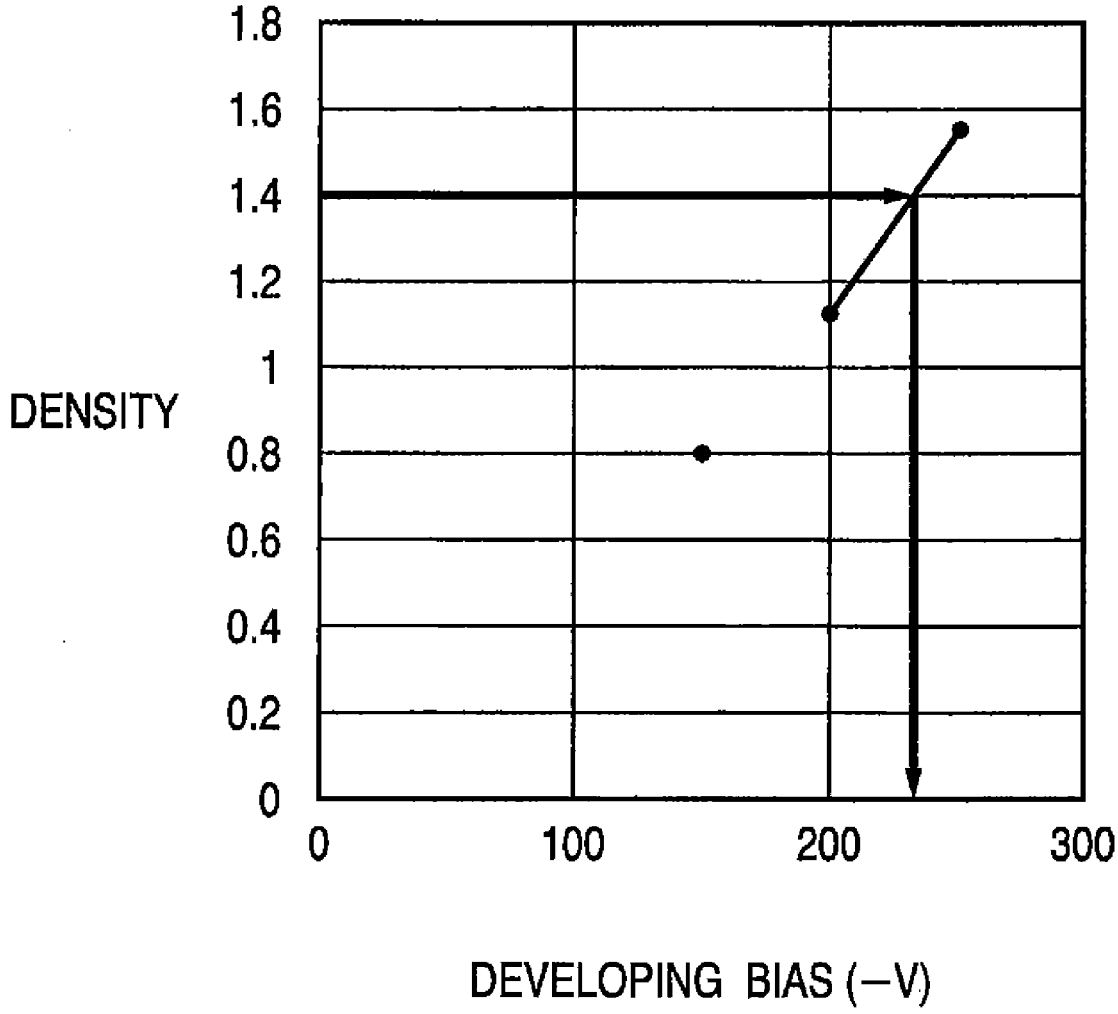
FIG. 19 is a diagram illustrating a method for calculating an optimum developing bias in order to obtain a desired density.

FIG. 19 is a diagram illustrating a method for calculating an optimum developing bias in order to obtain a desired density. In FIG. 19, the densities detected in three test images formed using three different developing biases are plotted. In this example, the density that does not cause transfer irregularity and satisfies a color reproduction range is 1.4. Thus, the adjusting part 1513 adjusts and determines the developing bias such that the density is 1.4.

FIG. 19 shows that the target density 1.4 is positioned between the density of the test image formed at −200 V and the density of the test image formed at −250 V. Thus, the adjusting part 1513 calculates the developing bias at which the density is 1.4, by performing linear interpolation between the two detected densities. In the example shown in FIG. 7, the developing bias in this case is −220 V.

In this manner, it is possible to acquire a developing bias at which a desired density is obtained, by detecting the densities of test images formed using a plurality of different developing biases. Thus, it is possible to secure a stable density regardless of the environment or the degree by which the apparatus has worn out.

<Tone Adjustment>

Figure 20:
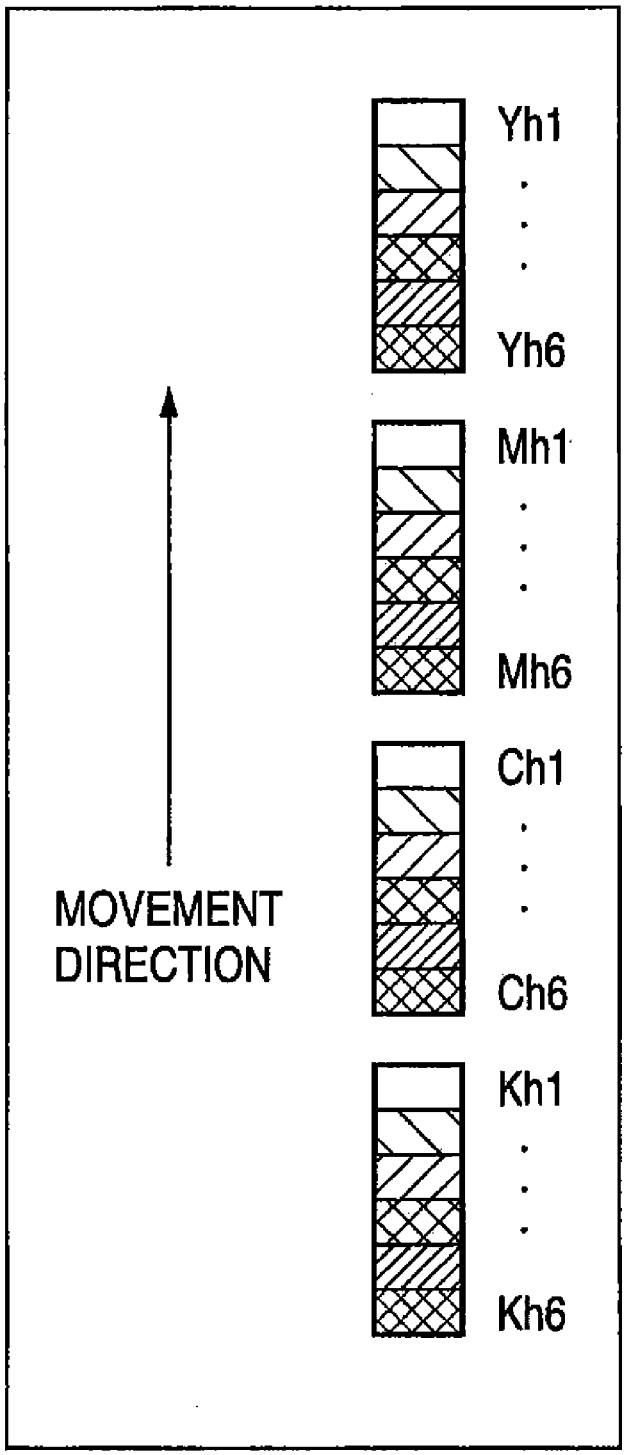
FIG. 20 is a diagram showing one example of test images used for tone adjustment.

FIG. 20 is a diagram showing one example of test images used for tone adjustment. In FIG. 20, six test images Yh1 to Yh6 are arranged with the toner density being gradually higher (coverage rate being higher). For example, Yh1 represents a test image having the lowest density among test images using yellow toner. Yh6 represents a test image having the highest density among test images using yellow toner. In a similar manner, Mh1 to Mh6 represent test images using magenta toner. Ch1 to Ch6 represent test images using cyan toner. Kh1 to Kh6 represent test images using black toner.

As shown in FIG. 20, the test images formed by the image forming stations corresponding to the respective colors are arranged in a straight line on the ETB 110. The density detecting sensor 120 detects the toner densities of the test images. Then, the adjusting part 1513 calculates a relational expression (γ-characteristics) of the density data with respect to the image data. The adjusting part 1513 sends the obtained information of the γ-characteristics to the p-correcting part 203. Based on the received information of the γ-characteristics, the γ-correcting part 203 updates the γ-correction table so as to obtain the desired γ-characteristics.

Herein, it is an object of the tone adjustment to predict and correct the γ-characteristics that are to be reproduced on a recording material. Thus, it is necessary that the density parameters when forming test images with each color are the same as the density parameters when forming images on a recording material, except for the transfer bias. On the contrary, it is necessary that the transfer bias applied for forming test images is different from the transfer bias applied during normal printing, in order to secure similar transfer characteristics in both a case where an image is transferred to the recording material and a case where an image is transferred to the ETB 110.

Furthermore, it is known that the γ-characteristics are strongly affected by the density parameters (example: the charge bias, the developing bias, and beam scanning conditions). Thus, when the density parameters are changed in the density adjustment, the γ-characteristics are also changed. Accordingly, it is preferable to perform the tone adjustment immediately after performing the density adjustment, that is, to perform the tone adjustment after performing the density adjustment, without forming an image on the recording material.

<Image Control in the Lower Speed Mode>

In the lower speed mode, the rotational speed of main image forming components, such as the photosensitive drum 105, the charge roller 106, the development rollers 108, and the ETB 110, is lower than the rotational speed of those in the normal mode. Thus, various values in the lower speed mode are slightly different from those in the normal mode. Examples of these values include the decay characteristics of the potential generated in toner by frictional electrification, and the potential of a charged component. In particular, the development characteristics (in particular, the γ-characteristics) in the lower speed mode are different from the development characteristics in the normal mode.

If the difference between the development characteristics and the tone characteristics in the normal mode and those in the lower speed mode is always constant, then it is possible to easily correct the respective characteristics by storing this difference. However, a difference (correlation) between the characteristics in the normal mode and the characteristics in the lower speed mode cannot be constant depending on environmental parameters, such as temperature and humidity, and the degree at which the image forming stations have been used. Accordingly, it is necessary to perform the image control not only in the normal mode but also in the lower speed mode. More specifically, it is preferable to prepare specific parameters (the image forming conditions and the γ-correction data) regarding the density and the tone, for both the lower speed mode and the normal mode.

In the image control in the lower speed mode, test images are formed on the ETB 110 in the lower speed mode, and the density of the test images are detected in the lower speed mode. Herein, depending on the characteristics in the lower speed mode, the pattern used for these test images may be different from the pattern for the normal mode. However, in order to simplify the sequence, the same pattern may be used for both of the test images. In this embodiment, the same pattern is used for both modes.

As described in FIG. 3, when measuring the density of test images, it is necessary to measure, in advance, the amount of reflection light on the ETB at positions where the test images are to be formed (base). The reason for this is that the amount of reflection light on the base is used as a reference in the measurement. Accordingly, the density detecting sensor 120 preferably measures the amount of reflection light from the base while the ETB 110 rotates a first lap, and measures the density of the test images in a second lap.

Herein, while the ETB 110 rotates two laps, it is preferable to keep the transport speed of the ETB 110 constant. If the transport speed is switched between the first lap and the second lap, then it is difficult to detect the density of the test images in the second lap at the same positions as the positions where the density of the base is detected in the first lap. As a result, the detection precision becomes poor. Thus, it is preferable to keep the lower speed mode while the ETB 110 rotates two laps.

In this manner, the time taken for the image control in the lower speed mode is longer than the time taken for the image control in the normal mode. Thus, as described at the beginning, it is not preferable to perform each time the image control in the normal mode and the image control in the lower speed mode because it increases the downtime.

COMPARATIVE EXAMPLE

Figure 21:
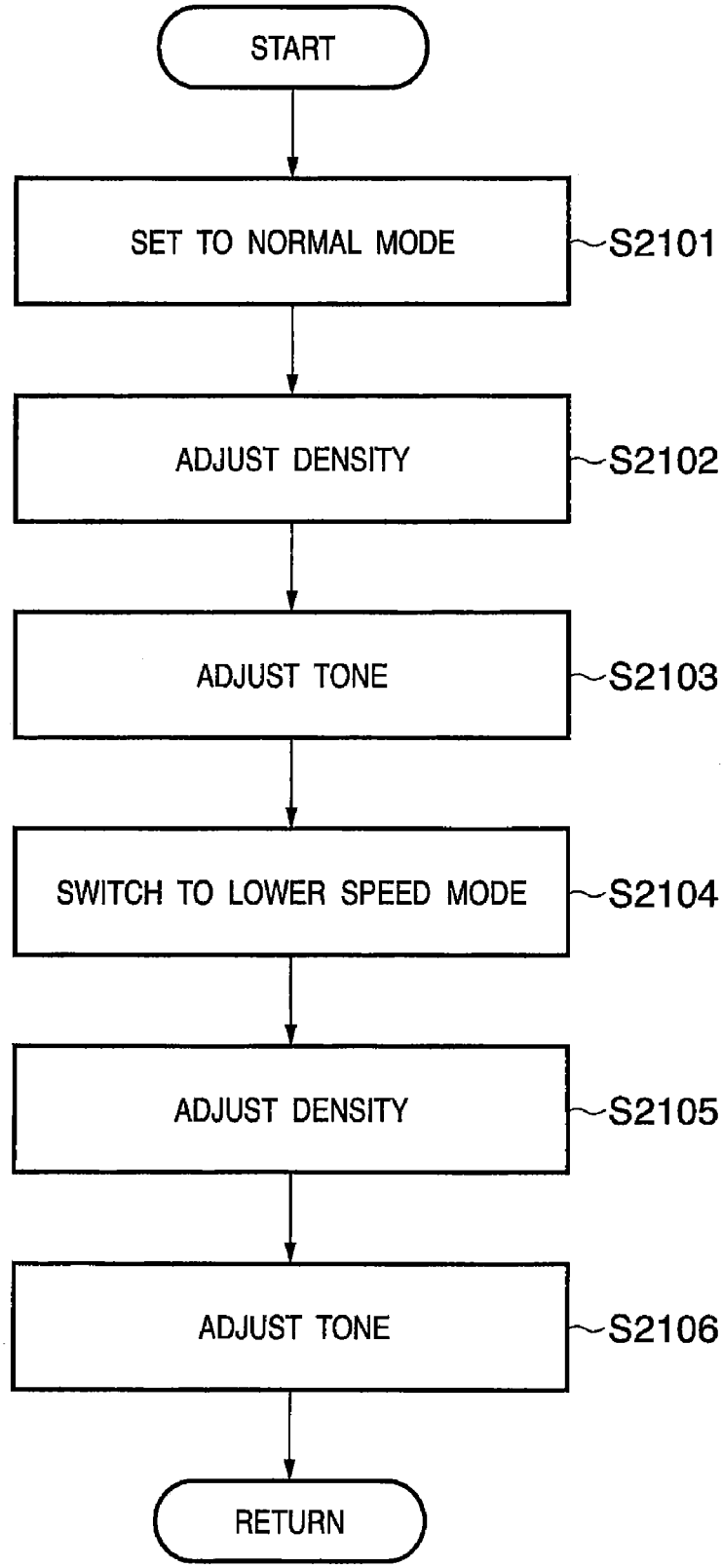
FIG. 21 is a flowchart of image control in a comparative example.

FIG. 21 is a flowchart of image control in a comparative example. In the image control in the comparative example, both of the image control in the normal mode and the image control in the lower speed mode are performed each time.

In step S2101, the control part 212 of the engine controller 210 sets the operation mode to the normal mode. Furthermore, the control part 212 activates the adjusting part 1513. In step S2102, the adjusting part 1513 performs the density adjustment in the normal mode. In step S2103, the engine controller 210 performs the tone adjustment in the normal mode. At that time, the adjusting part 1513 returns detected density data to the image forming controller 200. Based on the received density data, the γ-correcting part 203 updates the γ-correction table 205 for the normal mode.

In step S2104, the control part 212 switches the operation mode to the lower speed mode. Thus, the transport control circuit 216 lowers the processing speed. In step S2105, the adjusting part 1513 performs the density adjustment in the lower speed mode. In step S2106, the adjusting part 1513 performs the tone adjustment in the lower speed mode. At that time, the adjusting part 1513 returns detected density data to the image forming controller 200. Based on the received density data, the γ-correcting part 203 updates the γ-correction table 205 for the lower speed mode.

An experiment was conducted with this comparative example. In the experiment, the charge potential of the photosensitive drum 105 was fixed at −500 V. Furthermore, for each of YMCK toners, three test images were formed using respectively different developing biases (−150 V, −200 V, and −250 V). In the test images, a checkered pattern was used in which dots with the tone 100% and dots with the tone 0% were repeated. In this condition, the developing bias at which the density was 1.4 was calculated. Furthermore, for the tone adjustment, six types of test images with the tones 5%, 10%, 20%, 30%, 40%, and 70% were used for each toner. Herein, in the lower speed mode, the developing bias at which the density was 1.45 was calculated.

The image forming apparatus 100 formed images on approximately 5000 pages in an environment in which the temperature was 23° C. and the humidity was 50%. The image forming apparatus 100 formed images on approximately 500 pages per day, and then the power was turned off until the next day. This cycle was repeated for 10 days.

Before performing the image control, photographic images were formed respectively on plain paper in the normal mode and on glossy paper in the lower speed mode. Furthermore, after performing the image control, photographic images were formed in a similar manner respectively on plain paper in the normal mode and on glossy paper in the lower speed mode.

The number of the image controls and the time taken for the image controls in each mode were measured. As a result, the number of the image controls in the normal mode was 30. Furthermore, the number of the image controls in the lower speed mode was also 30. The time taken for the image controls was 45 minutes in total.

Although the tint slightly fluctuated between a time before and a time after the image control, the tint of printed matters after the image control was stable in both the plain paper and the glossy paper. Furthermore, after the image control, there was no problem of character scattering or fluctuation in the line width.

Figure 22:
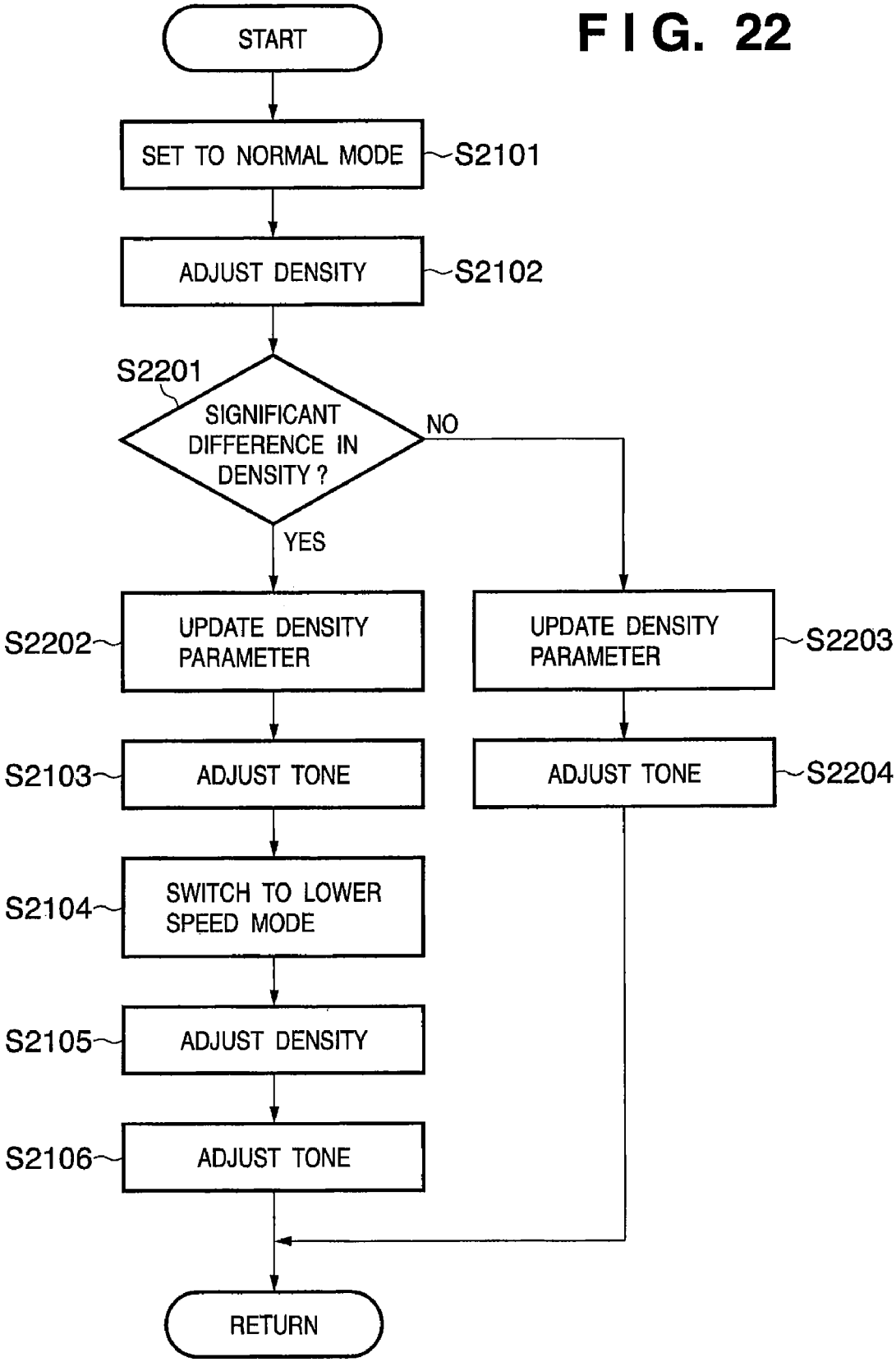
FIG. 22 is a flowchart showing image control according to a third embodiment of the invention.

FIG. 22 is a flowchart showing image control according to the third embodiment. Components that have been already described are given the same reference numbers as above, and their description has been simplified.

When the density adjustment has been completed in step S2102, then the procedure proceeds to step S2201. In step S2201, the control part 212 judges whether or not there is a significant difference between the density parameters adjusted last time and stored in the storing part 214 and the density parameters adjusted this time. Examples of the density parameters include DC values of the charge bias and the developing bias. If images are formed at a constant charge bias, then the control part 212 may compare only the DC values of the developing biases. Instead of the density parameters, density data that has been actually detected may be used.

For example, if the DC value of the last developing bias was −218 V, and the DC value of the current developing bias is −220 V, then a difference between these biases is 2 V. If the difference is smaller than a predetermined value (example: 7 V), then the control part 212 judges that there is no significant difference. If there is no significant difference, then the procedure proceeds to step S2203. In step S2203, the control part 212 writes the adjusted parameters in the storing part 214. Thus, the density parameters are updated.

Subsequently, in step S2204, the control part 212 lets the adjusting part 1513 perform the tone adjustment. It will be appreciated that in this tone adjustment, the updated density parameters are used.

On the other hand, if there is a significant difference, then the procedure proceeds to step S2202, where the control part 212 writes the adjusted parameters in the storing part 214. Subsequently, steps S2103 to S2106 are performed in the above-described manner.

An experiment was conducted on the third embodiment, in the same conditions as those for the comparative example. As a result, the number of the image controls in the normal mode was 30. Furthermore, the number of the image controls in the lower speed mode was 8. In the third embodiment, the number of the image controls in the lower speed was smaller, by as many as 22, than that in the comparative example. Furthermore, the time taken for the image controls was shortened by as much as 22 minutes. It should be noted that although the time taken for the image controls was shortened in this manner, there was no quality problem regarding the tint, character scattering, or the line width.

According to this embodiment, in the image forming apparatus 100, based on parameters that have been adjusted or density data that has been detected in a first operation mode of a plurality of operation modes, it is controlled whether or not to form and detect test images, and adjust parameters in a second operation mode of the plurality of operation modes. More specifically, the image controls in the second operation mode are less frequently performed, and thus the time taken for the image controls is shortened. Accordingly, the downtime is shortened. Moreover, there is also the advantage that the amount of a developer consumed in the image controls is reduced. Herein, the quality of the image is not deteriorated although the time taken for the image controls is shortened.

First, the control part 212 lets the adjusting part 1513 adjust density parameters (at least one of the charge conditions and the development conditions) in the first operation mode (S2102). Subsequently, the control part 212 lets the adjusting part 1513 form and detect test images, and to adjust parameters in the second operation mode (S2105, S2106). Herein, if the charge conditions are constant, then the adjusting part 1513 may adjust only the development conditions, and thus the adjustment process becomes simple.

Furthermore, the control part 212 allows the adjusting part 1513 to adjust the tone parameters while changing latent image forming conditions (example: the amount of the scanning light beam of the beam scanner unit) when forming test images in the second operation mode. More specifically, test images are formed respectively for a plurality of different image forming conditions, and their densities are detected. Thus, the tone parameters can be adjusted in a preferable manner.

Furthermore, the control part 212 lets the adjusting part 1513 adjust the density parameters and the tone parameters in the first operation mode. Subsequently, the control part 212 switches the operation mode from the first operation mode to the second operation mode. Then, the control part 212 lets the adjusting part 1513 adjust the density parameters and the tone parameters in the second operation mode. In this manner, the density adjustment and the tone adjustment in each mode are continuously performed, and thus there is the advantage that the operation modes (processing speeds) are switched only once.

Generally, when switching the operation modes, it is necessary to switch the rotational speed of a polygon mirror in the beam scanner unit 107, to automatically detect a bias applied to the transfer roller, and to bring the development rollers away from each other and into contact with each other in order to prevent a shock. Thus, a considerable length of preparation time is necessary. Accordingly, it is preferable that the operation modes are switched the minimum necessary number of times. This embodiment is very preferable in that the operation modes are switched only once.

Furthermore, the density data or the density parameters of the test images that has been detected in the first operation mode may be stored and held in the storing part 214. In this case, if a difference between the detected current density data (or adjusted density parameter values) and the density data stored in the storing part 214 exceeds a threshold value, then the control part 212 lets the adjusting part 1513 perform the density adjustment also in the second operation mode.

In this manner, the control part 212 can preferably judge whether or not it is necessary to perform the density adjustment or the tone adjustment in the second operation mode, based on a change in the density data or the density parameters in the first operation mode. Generally, if there is a significant change in the density data or the density parameters in the first operation mode, then it is highly possible that there is a significant change in the density data or the density parameters also in the second operation mode. Thus, it would be reasonable to use the density data or the density parameters as a reference in the judgment. It is possible to judge whether or not there is a significant change, based on whether or not a difference between the last density data and the current density data exceeds a threshold value.

Herein, the processing speed in the first operation mode may be or may not be higher than the processing speed in the second operation mode. However, if the first operation mode is the normal mode having a relatively higher speed, then the effect of shortening the downtime is higher than that in the case where the first operation mode is the lower speed mode. The reason for this is that as the processing speed is higher, the time necessary for the image control is shorter.

Fourth Embodiment

Figure 23:
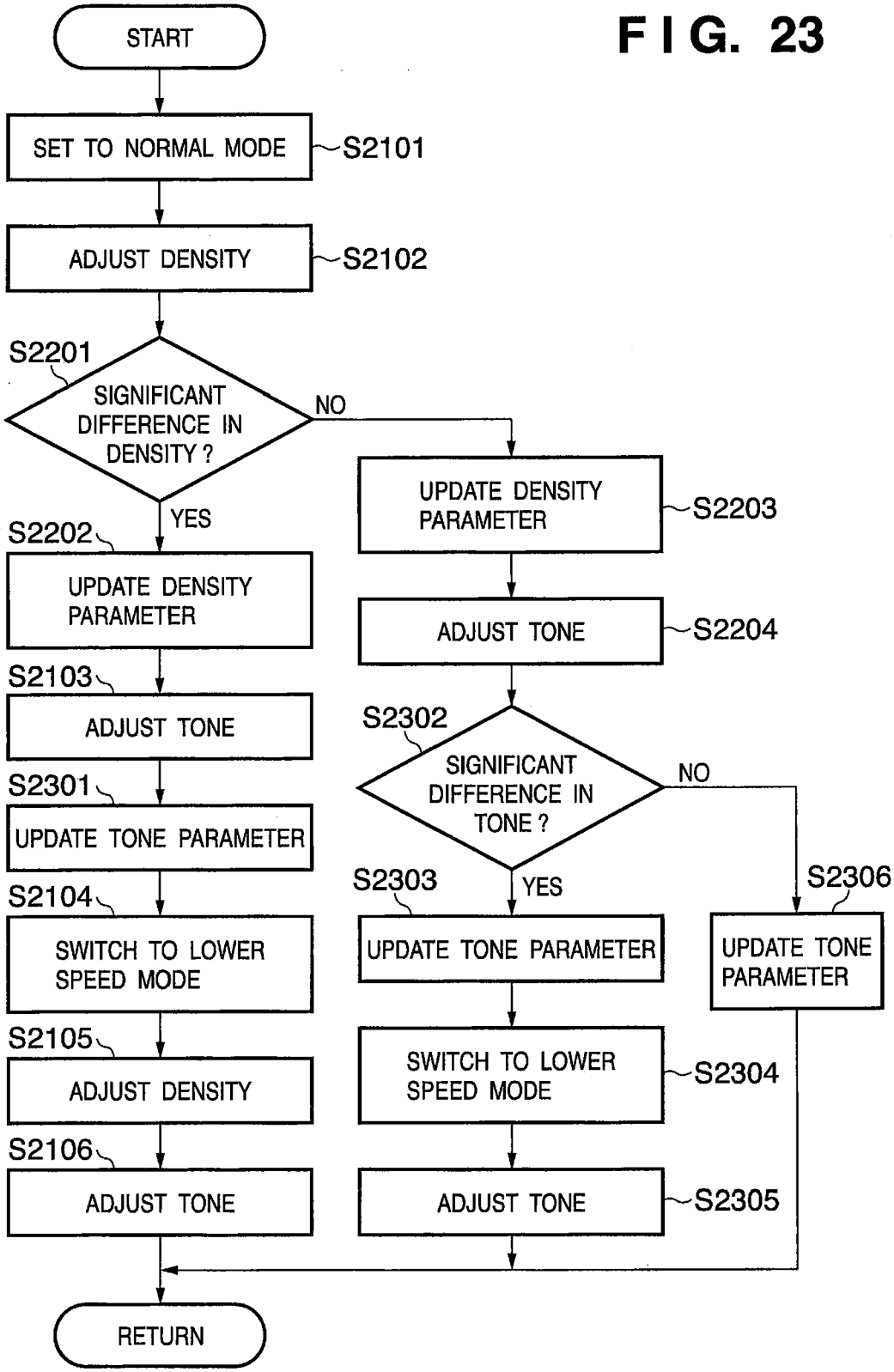
FIG. 23 is a flowchart showing image control according to a fourth embodiment of the invention.

FIG. 23 is a flowchart showing image control according to a fourth embodiment of the invention. Components that have been already described are given the same reference numbers as above, and their description has been simplified.

This flowchart has step S2301 added between steps S2103 and S2104 that have been shown in FIG. 22. In step S2301, the adjusting part 1513 lets the storing part 214 store the density data of each color that has been detected by the density detecting sensor 120. Herein, the density data of the test images with respectively different tones (coverage rates) corresponds to the tone parameters. The density data is stored for each test image. For example, when six test images with respectively different densities are formed for each of four toner colors, 24 pieces of density data in total are stored in the storing part 214. Furthermore, this flowchart has steps S2302 to S2306 added after step S2204 that has been shown in FIG. 22. The reason for holding the tone parameters in the storing part 214 in this manner is to judge whether or not there is a significant difference between the last tone parameters and the current tone parameters. If the difference exceeds a threshold value, then it is judged that there is a significant difference. If there is a significant difference in the toner parameters in the normal mode, then it is generally necessary to perform the tone adjustment in the lower speed mode.

In step S2302, the control part 212 judges whether or not there is a significant difference between the current tone parameters acquired in step S2204 and the last tone parameters stored in the storing part 214.

For example, with respect to three test images with a coverage rate of less than 30%, if a change between the last density and the current density is 0.05 or more on average, then the control part 212 judges that there is a significant difference. Alternatively, with respect to three test images with a coverage rate of 30% or more, if a change between the last density and the current density is 0.10 or more on average, then it is judged that there is a significant difference. Herein, it is preferable that these threshold values are determined based on experience in accordance with the type of the image forming apparatus. If there is no significant difference, then the procedure proceeds to step S2306, where the adjusting part 1513 lets the storing part 214 store the tone parameters that have been detected by the density detecting sensor 120.

If there is a significant difference, then the procedure proceeds to step S2303, where the adjusting part 1513 lets the storing part 214 store the tone parameters that have been detected by the density detecting sensor 120. In step S2304, the control part 212 switches the operation mode to the lower speed mode. In step S2305, the control part 212 lets the adjusting part 1513 perform the tone adjustment in the lower speed mode.

In order to confirm an effect of the image control according to the fourth embodiment, an experiment was conducted. The experiment was conducted in an environment in which the temperature arbitrarily changed in the range from 17° C. to 25° C. and the humidity arbitrarily changed in the range from 40% to 70%. Other conditions were the same as those adopted in the comparative example.

As the results of the experiment, the number of the image controls in the normal mode was 30. Furthermore, the number of the density adjustments in the lower speed mode was 12. The number of the tone adjustments in the lower speed mode was 18. The number of the density adjustments in the lower speed mode was smaller by 18 than that in the comparative example. Furthermore, the number of the tone adjustments in the lower speed mode was smaller by 12. The time taken for the image controls was 30 minutes in total. In other words, the time was made shorter by 15 minutes than that in the comparative example. It should be noted that although the time taken for the image controls was shortened in this manner, there was no quality problem regarding the tint, character scattering, or the line width.

This embodiment has the advantage that the tone adjustment in the second operation mode can be omitted if there is no significant difference between the last tone parameters and the current tone parameters. In particular, according to this embodiment, the image quality of the image forming apparatus 100 can be maintained even in a severe environment in which the environmental parameters (example: the temperature and the humidity) are not stable.

Fifth Embodiment

Figure 24:
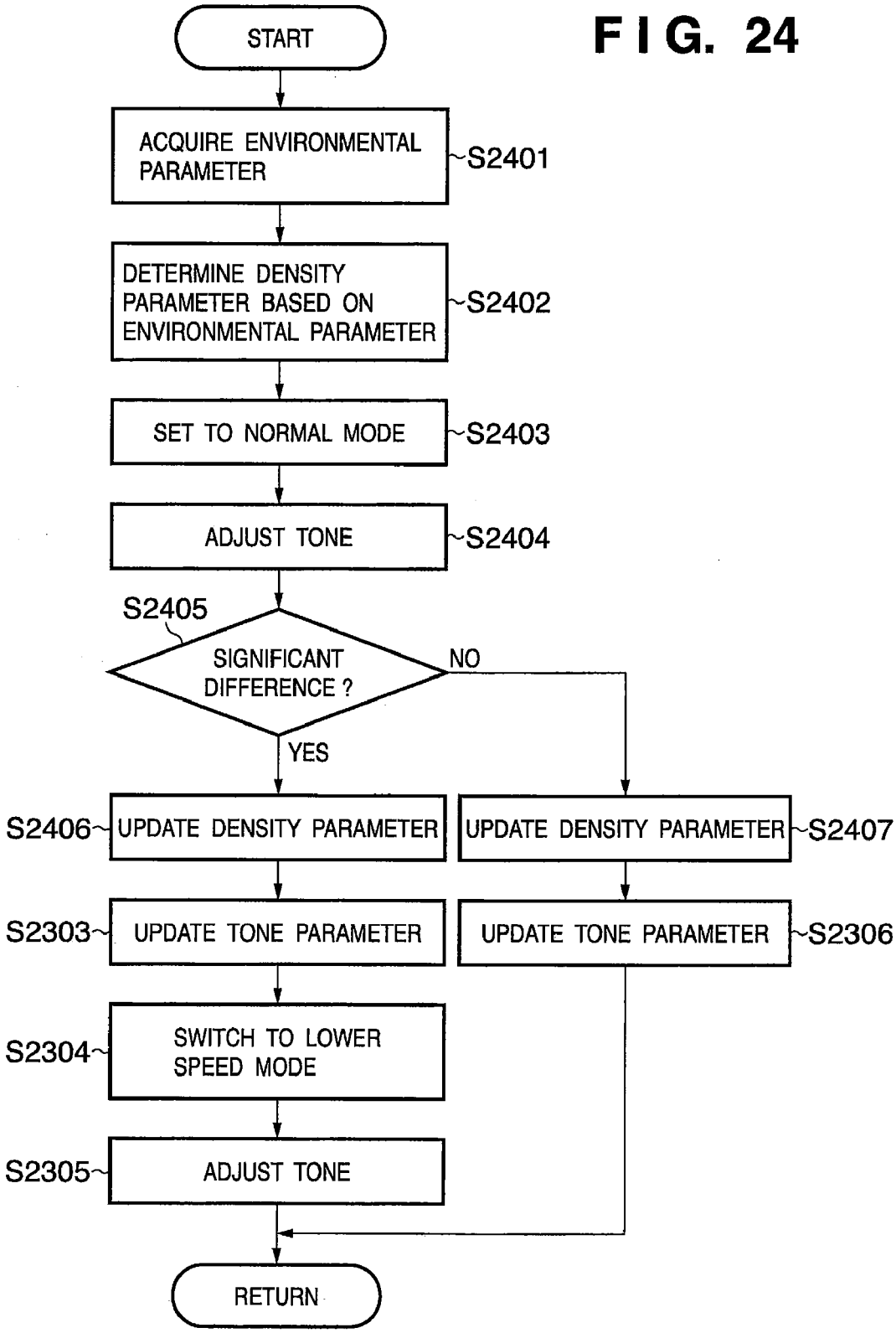
FIG. 24 is a flowchart showing image control according to a fifth embodiment of the invention.

FIG. 24 is a flowchart showing image control according to a fifth embodiment of the invention. In this example, the density parameters are determined based on the environmental parameters that have been acquired by the environmental sensor.

In step S2401, the control part 212 uses the environmental sensor 1517 to acquire the environmental parameters regarding the environment in which the image forming apparatus 100 has been installed. Examples of the environmental parameters include the temperature and the humidity.

In step S2402, the control part 212 uses a reference table stored in the storing part 214 to determine the density parameters corresponding to the acquired environmental parameters. For example, if the detected temperature is 23° C. and the detected humidity is 50%, then the developing bias is determined to be −220 V based on the reference table.

In step S2403, the control part 212 sets the operation mode to the normal mode. In step S2404, the control part 212 lets the adjusting part 1513 perform the tone adjustment in the normal mode. As the density parameters at that time, the density parameters that have been determined in step S2402 are used. The adjusting part 1513 sends, to the γ-correcting part 203, the tone parameters (a plurality of pieces of the density data) that have been detected by the density detecting sensor 120. Based on the received tone parameters, the γ-correcting part 203 updates the γ-correction table 205 for the normal mode.

In step S2405, the control part 212 judges whether or not there is a significant difference in at least one of the current tone parameters and the current environmental parameters (or the density parameters). More specifically, the control part 212 judges whether or not the image control in the lower speed mode is necessary. It is judged whether or not there is a significant difference, by comparing the difference with a threshold value.

For example, with respect to three test images with a coverage rate of less than 30%, if a change between the last density and the current density is 0.05 or more on average, then the control part 212 judges that there is a significant difference. Alternatively, with respect to three test images with a coverage rate of 30% or more, if a change between the last density and the current density is 0.10 or more on average, then it is judged that there is a significant difference. It is also possible to judge whether or not a difference between the environmental parameters obtained in the last image control and the current environmental parameters exceeds a threshold value. It is also possible to judge whether or not a difference between the last image forming conditions and the currently determined image forming conditions exceeds a threshold value. For example, if a difference between the last developing bias and the current developing bias exceeds 7 V, then it is judged that there is a significant difference.

If there is a significant difference, then the procedure proceeds to step S2406, where the control part 212 writes the current density parameters in the storing part 214. Subsequently, steps S2303 to S2305 described above are performed.

If there is no significant difference, then the procedure proceeds to step S2407, where the control part 212 writes the current density parameters in the storing part 214. Subsequently, step S2306 described above is performed.

In order to confirm an effect of the image control according to the fifth embodiment, an experiment was conducted. The experiment was conducted in an environment in which the temperature arbitrarily changed in the range from 17° C. to 25° C. and the humidity arbitrarily changed in the range from 40% to 70%. Other conditions were the same as those adopted in the comparative example.

As the results of the experiment, the number of the tone adjustments in the normal mode was 30. Furthermore, the number of the tone adjustments in the lower speed mode was 18. The number of tone adjustments in the lower speed mode was smaller, by as many as 12, than that in the comparative example. Furthermore, the time taken for the image controls was 17 minutes in total. Thus, the time was made shorter by as much as 28 minutes than that in the comparative example. It should be noted that although the time taken for the image controls was shortened in this manner, there was no quality problem regarding the tint, character scattering, or the line width.

According to this embodiment, the adjusting part 1513 can determine the density parameters based on the environmental parameters that have been detected by the environmental sensor 1517. In this case, it is not necessary for the adjusting part 1513 to form test images in order to determine the density parameters. Thus, the downtime is further shortened. Moreover, the amount of a developer consumed in the image control is also reduced.

Other Embodiment

In the foregoing embodiments, a color image forming apparatus using an electrostatic adsorptive transfer belt was used as an example. However, the present invention is not limited to this. For example, the present invention can be preferably applied also to a color image forming apparatus that performs a primary transfer in which a toner image on a photosensitive member is transferred onto an intermediate transferring member, and then performs a secondary transfer in which the toner image is transferred onto a recording material. In this case, the density of a test image formed on the intermediate transferring member is detected by the density detecting sensor.

Furthermore, the present invention can be preferably applied also to an image forming apparatus having a plurality of operation modes in which the definition or the number of halftone lines changes as F the processing speed changes. For example, in the normal mode, a low-definition image is formed at a normal processing speed. On the other hand, in the lower speed mode, a high-definition image is formed at a relatively lower processing speed.

In the foregoing embodiments, the adjusting part 1513 adjusted DC values of the developing bias in the density adjustment, but the adjusting part 1513 may adjust other image forming parameters. For example, the charge bias, the transfer bias, or other high voltage values relating to the image formation may be changed for each test image.

In the foregoing embodiments, the optical density detecting sensor 120 was used, but the present invention is not affected by a detection method of a sensor. Furthermore, the density data may be the weight of toner itself, as well as the amount of toner attached corresponding to the amount of reflection light.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-359534, filed Dec. 13, 2005, Japanese Patent Application No. 2005-380170, filed Dec. 28, 2005 which are hereby incorporated by reference herein in their entirety.

What is claimed is:

1. An image forming apparatus comprising:

an image forming part, which forms an image in any one of a plurality of image forming modes with respectively different processing speeds;

a density calibration control part, which performs image density control for said image forming part in a state where any one of the plurality of image forming modes is applied, wherein said density calibration control part makes a performing time interval for the image density control in a first image forming mode and a performing time interval for the image density control in a second image forming mode different from each other, and wherein if the image density control is performed in the first image forming mode, then said density calibration control part determines an image forming condition for the second image forming mode that has not been performed, based on results of the image density control; and a storing part, which stores a first table and a second table for determining an image forming condition that is used in the first image forming mode, and a third table and a fourth table for determining an image forming condition that is used in the second image forming mode; and a selecting part, which selects the first table and the fourth table when the image density control is performed in the first image forming mode, and selects the second table and the third table when the image density control is performed in the second image forming mode, wherein the first table is a table for determining an image forming condition for the first image forming mode, based on results of the image density control acquired in the first image forming mode, the second table is a table for determining an image forming condition for the first image forming mode, based on results of the image density control acquired in the second image forming mode, the third table is a table for determining an image forming condition for the second image forming mode, based on results of the image density control acquired in the second image forming mode, and the fourth table is a table for determining an image forming condition for the second image forming mode, based on results of the image density control acquired in the first image forming mode.

2. The image forming apparatus according to claim 1, wherein if a processing speed in the second image forming mode is lower than a processing speed in the first image forming mode, then said density calibration control part makes the performing time interval for the image density control in the second image forming mode longer than the performing time interval for the image density control in the first image forming mode.

3. The image forming apparatus according to claim 1, further comprising:

an image carrier, which carries an image; and a density detecting part, which detects a density of a test image formed on said image carrier by said image forming part, wherein said density calibration control part performs the image density control based on the detected density data of the test image.

* * * * *